US011952200B1

(12) United States Patent
Blanch et al.

(10) Patent No.: US 11,952,200 B1
(45) Date of Patent: Apr. 9, 2024

(54) SNACK CONTAINMENT AND DISPENSING APPARATUS AND USE THEREOF

(71) Applicant: Tomo Technologies, Inc., Provo, UT (US)

(72) Inventors: Joseph Blanch, Raleigh, NC (US); Necip Buber, Ankara (TR)

( * ) Notice: Subject to any disclaimer, the term of this patent is extended or adjusted under 35 U.S.C. 154(b) by 138 days.

(21) Appl. No.: 17/588,372

(22) Filed: Jan. 31, 2022

Related U.S. Application Data

(63) Continuation-in-part of application No. 16/711,491, filed on Dec. 12, 2019, now Pat. No. 11,259,661.

(51) Int. Cl.
*B65D 83/00* (2006.01)

(52) U.S. Cl.
CPC ..... *B65D 83/0038* (2013.01)

(58) Field of Classification Search
CPC ..... A61J 7/0445
See application file for complete search history.

(56) References Cited

U.S. PATENT DOCUMENTS 9,414,701 B1 * 8/2016 Yen ..... B65D 43/16
2002/0096217 A1 * 7/2002 Wu ..... F16K 15/028 137/543.19
2003/0127463 A1 * 7/2003 Varis ..... G07F 11/62 221/13
2004/0035876 A1 * 2/2004 Lo ..... B65D 83/0454 221/25
2006/0000833 A1 * 1/2006 Boots ..... B65D 43/162 215/245
2006/0186077 A1 * 8/2006 Robinson ..... B65D 50/046 220/259.2
2014/0339249 A1 * 11/2014 Reddy ..... G16H 20/13 221/1
2016/0022543 A1 * 1/2016 Deeter ..... A61J 7/0427 221/154
2016/0107820 A1 * 4/2016 Macvittie ..... B65D 83/0454 221/13

FOREIGN PATENT DOCUMENTS

WO WO 2018/126190 * 12/2017 ..... A61J 7/00

* cited by examiner

*Primary Examiner* — Gene O Crawford
*Assistant Examiner* — Ayodeji T Ojofeitimi
(74) *Attorney, Agent, or Firm* — Sandy Lipkin

(57) ABSTRACT

The present invention is a snack containment and dispensing apparatus having a plurality of separate snack containment compartments, a preferably transparent lid having an opening therein, and a lockable plunger or like means to index or rotate the lid such that access to a singular snack compartment is obtained one-at-a-time. The rotation of the tray can alternately be accomplished through electromechanical means or through a ratcheting handle on the outside of the tray. The electromechanical actuation can be connected to external devices to track data about the use and contents of the device. Additionally, a door latch on the lid can selectively attach to and release from the tray through the depression of a door latch actuator. Additionally, the contents of the tray can be temperature controlled either through a passive heating or cooling back in the wall of the tray or through electromechanical means. An airtight seal can be created through the depression of a bottom button that pushes the tray and lid together into an airtight seal.

3 Claims, 23 Drawing Sheets

SNACK CONTAINMENT AND DISPENSING APPARATUS AND USE THEREOF

BACKGROUND OF THE INVENTION

Reference to Prior Application

This application is a Continuation-in-Part of U.S. patent application Ser. No. 16/711,491 filed on Dec. 12, 2019 entitled SNACK CONTAINMENT DISPENSING APPARATUS AND USE THEREOF to Joseph Blanch, Westin Dangerfield and Solanda Moran.

FIELD OF THE INVENTION

The present invention relates to ingestibles containment and dispensing apparatuses, and in particular, to containment apparatuses having selective dispensing of snacks while providing spill resistance of such snacks and entertainment for the apparatus user, and methods of use thereof.

DESCRIPTION OF THE PRIOR ART

Various devices are known in the art to convert linear motion into a torque or rotational/angular motion. Exemplary of such devices is U.S. Pat. No. 5,797,319 entitled "Drive Device for a Folder in a Printing Press" to Tomczak which is expressly incorporated herein by reference. Various means and devices are known in the art for storing snacks and like ingestibles, and for selectively dispensing and/or rendering availability to such snacks. However, such means and devices have typically been rendered substantially the whole of such snacks spillable or have been void of an entertainment aspect.

SUMMARY OF THE INVENTION

The preferred embodiment of the instant invention teaches a snack containment and dispensing apparatus comprising a tray including one or more pockets; a lid connectable with the tray and including an opening, the tray is configured for selective rotation relative to the lid to align one of the one or more pockets with the opening; an actuator configured to actuate rotation of the tray, the actuator includes a rotation mechanism that includes a base and a tubular portion, the tubular portion includes a plurality of vertical channels connected by a plurality of transverse channels to facilitate selective rotation of the tray; and a door latch connected to said lid at said opening wherein said door latch can releasably attach to said tray by the toggling of said latch from a first position to a second position wherein said door latch is moveable between said first and said second position through the manual depression of a door latch actuator attached to said lid wherein when said door latch actuator is toggled into said first position, said door latch slides into said tray to lock said lid at a specific location and when said door latch actuator is toggled into said second position, said door latch slides out of said tray to release said door latch from said lid at said specific location.

An alternate embodiment of the instant invention teaches a snack containment and dispensing apparatus comprising a tray including one or more pockets; a lid connectable with the tray and including an opening, the tray is configured for selective rotation relative to the lid to align one of the one or more pockets with the opening; an actuator configured to actuate rotation of the tray, the actuator includes a rotation mechanism that includes a base and a tubular portion, the tubular portion includes a plurality of vertical channels connected by a plurality of transverse channels to facilitate selective rotation of the tray; and wherein said actuator configured to actuate rotation of said tray is removed and wherein said rotation of said tray is accomplished by a PCB with microcontroller wherein said PCB with microcontroller is connected to and powered by a battery and wherein said PCB with microcontroller receives input from a position sensor and wherein said PCB with microcontroller receives additional input from an electromechanical switch and wherein said PCB with microcontroller is attached to a motor with a gearbox wherein said motor with gearbox is coupled to said tray to allow for said rotation of said tray through electromechanical means.

The above embodiment can be further modified by defining that said battery attached to said PCB with microcontroller is in wireless communication with an external device so that said data can be collected that are trackable by said external device, said data including tray rotations, opening and closing cycles of said lid, the amount of food in said tray, how much food has been consumed from said tray.

A second alternate embodiment of the instant invention teaches a snack containment and dispensing apparatus comprising a tray including one or more pockets; a lid connectable with the tray and including an opening, the tray is configured for selective rotation relative to the lid to align one of the one or more pockets with the opening; and an actuator configured to actuate rotation of the tray, the actuator includes a rotation mechanism that includes a base and a tubular portion, the tubular portion includes a plurality of vertical channels connected by a plurality of transverse channels to facilitate selective rotation of the tray wherein contents in said tray can be temperature controlled through the inclusion of an icepack or a warm pack integrated into a wall of said tray or into the bowl.

The above embodiment can be further modified by defining that wherein said tray can be temperature controlled through the integration of electronics wherein said electronics include a PCB with a thermostat wherein said PCB with said thermostat is connected to a thermometer and a power source and a means to either cool or heat said tray.

A third alternate embodiment of the instant invention teaches a snack containment and dispensing apparatus comprising a tray including one or more pockets; a lid connectable with the tray and including an opening, the tray is configured for selective rotation relative to the lid to align one of the one or more pockets with the opening; and an actuator configured to actuate rotation of the tray, the actuator includes a rotation mechanism that includes a base and a tubular portion, the tubular portion includes a plurality of vertical channels connected by a plurality of transverse channels to facilitate selective rotation of the tray wherein said actuator is lockable into a locked position by depressing said actuator to actuate rotation and wherein said actuator further comprises a recessed female portion at a bottom portion of said actuator into which a male portion of said actuator at said bottom portion of said actuator can rotate therein and thereby lock said actuator therein.

A fourth alternate embodiment of the instant invention teaches a snack containment and dispensing apparatus comprising a tray including one or more pockets; a lid connectable with the tray and including an opening, the tray is configured for selective rotation relative to the lid to align one of the one or more pockets with the opening; an actuator configured to actuate rotation of the tray, the actuator includes a rotation mechanism that includes a base and a tubular portion, the tubular portion includes a plurality of vertical channels connected by a plurality of transverse channels to facilitate selective rotation of the tray; and a sealing actuator on a bottom of said tray wherein when sealing actuator is activated, said tray is pushed upward into said lid and attached thereto thereby creating an airtight seal.

A fifth alternate embodiment of the instant invention teaches a snack containment and dispensing apparatus comprising a tray including one or more pockets; a lid connectable with the tray and including an opening, the tray is configured for selective rotation relative to the lid to align one of the one or more pockets with the opening; an actuator configured to actuate rotation of the tray, the actuator includes a rotation mechanism that includes a base and a tubular portion, the tubular portion includes a plurality of vertical channels connected by a plurality of transverse channels to facilitate selective rotation of the tray; and a ratcheting handle located around a perimeter of said tray wherein rotation of said tray is accomplished through manual ratcheting of said handle around said perimeter rather than through actuation of said actuator

BRIEF DESCRIPTION OF THE DRAWINGS

For a better understanding of the present invention, reference is to be made to the accompanying drawings. It is to be understood that the present invention is not limited to the precise arrangement shown in the drawings.

The present disclosure will become more readily apparent from the specific description accompanied by the following drawings, in which.

DETAILED DESCRIPTION OF A PREFERRED EMBODIMENT

The described features, structures, or characteristics of the invention may be combined in any suitable manner in one or more embodiments. In the following description, numerous specific details are included to provide a thorough understanding of embodiments of the invention. One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

The system of the present disclosure may be understood more readily by reference to the following detailed description of the embodiments taken in connection with the accompanying drawing figures, which form a part of this disclosure. It is to be understood that this application is not limited to the specific devices, methods, conditions or parameters described and/or shown herein, and that the terminology used herein is for the purpose of describing particular embodiments by way of example only and is not intended to be limiting. In some embodiments, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure. For example, the references "upper" and "lower" are relative and used only in the context to the other, and are not necessarily "superior" and "inferior".

The following discussion includes a description of a snack containment and dispensing apparatus in accordance with the principles of the present disclosure. Alternate embodiments are also disclosed. Reference is made in detail to the exemplary embodiments of the present disclosure, which are illustrated in the accompanying figures. Turning to FIGS. 1-14, there are illustrated components of a snack containment and dispensing apparatus, such as, for example, a container system 10. Container system 10 is configured to allow access to one compartment of a tray at a time by providing for selective rotation of the tray for alignment with an opening disposed with a lid.

Figure 1:
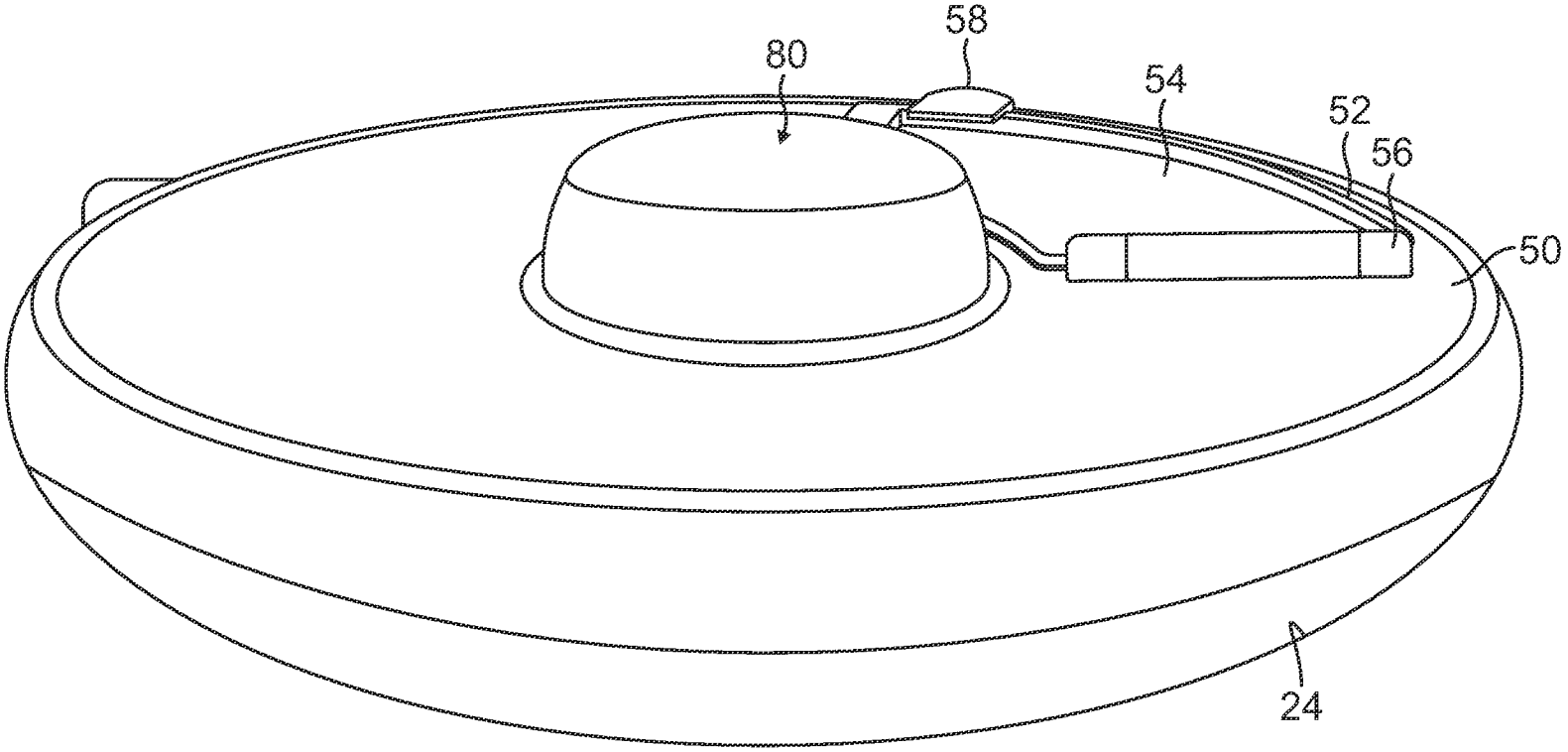
FIG. 1 is a perspective view of the components of one embodiment of a snack containment and dispensing apparatus in accordance with the principles of the present disclosure.
Figure 2:
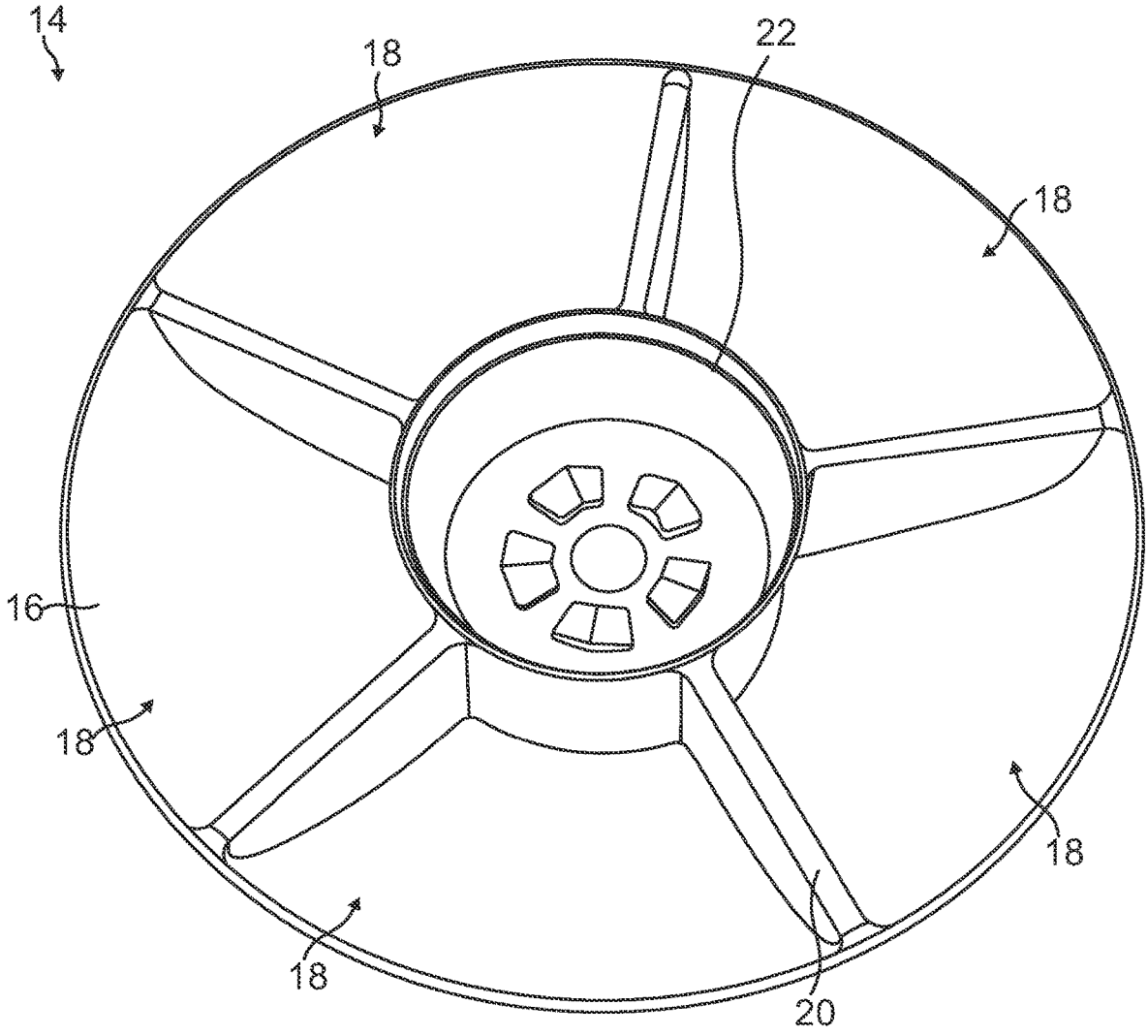
FIG. 2 is a plan view of the components of one embodiment of a snack containment and dispensing apparatus in accordance with the principles of the present disclosure.
Figure 3:
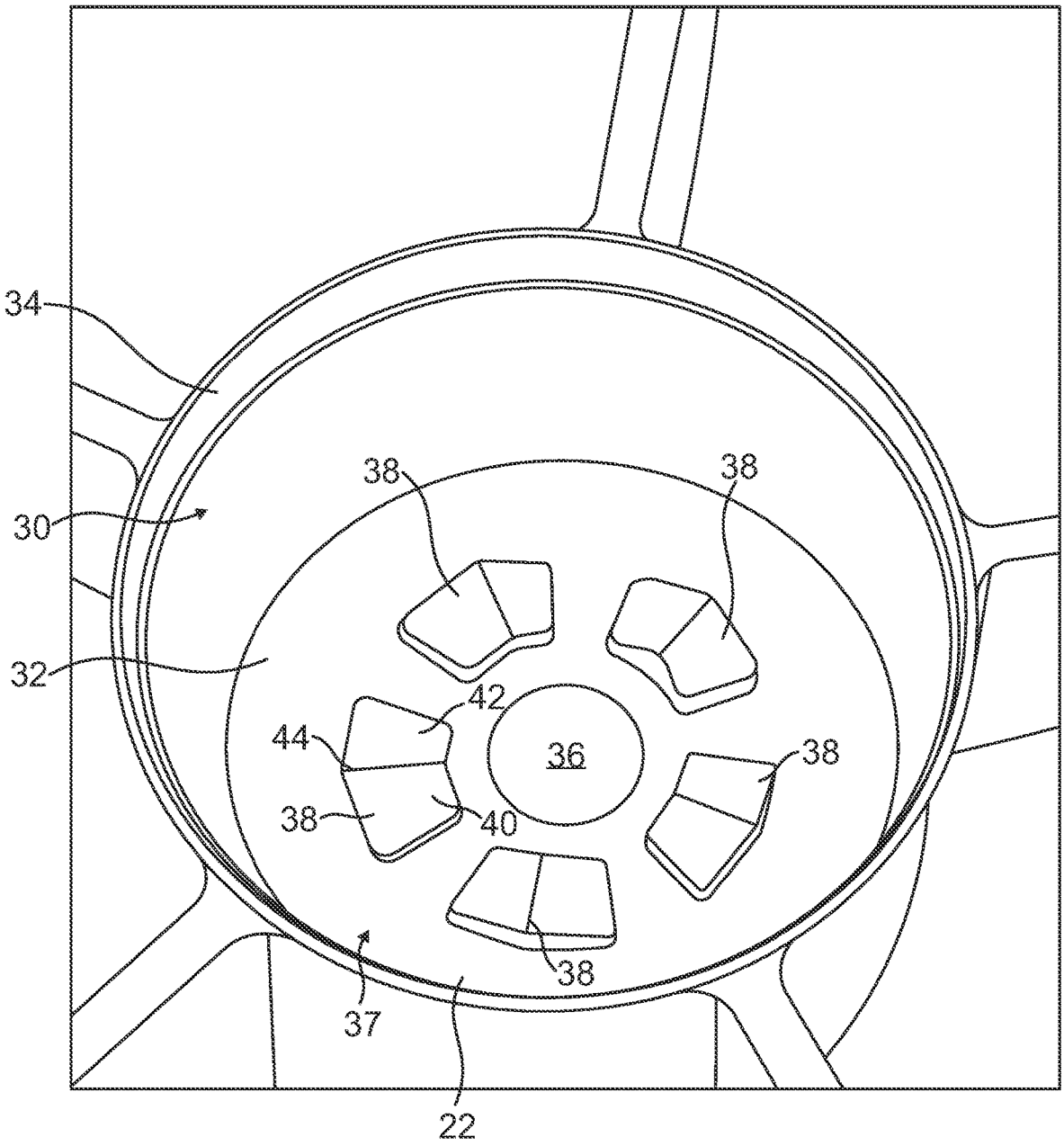
FIG. 3 is an enlarged view of the components of FIG. 2

Container system 10 includes a tray 14 configured to contain snacks S therein. Tray 14 includes a substantially round dish shaped member. Tray 14 includes a surface 16 that defines one or a plurality of containment compartments, for example, pockets 18. Pockets 18 are separated by walls 20. Pockets 18 may include various configurations, for example, oval, oblong, triangular, square, polygonal, irregular, uniform, non-uniform, offset, staggered, and/or tapered. Pockets 18 are circumferentially disposed about a central opening 22, as shown in FIG. 2 Snacks S are disposable within pockets 18, as shown in FIGS. 2 and 3. Walls 20 provide a separation between snacks S. Tray 14 is selectively rotatable to provide access to one of pockets 18, as described herein. Tray 14 includes an outer bottom surface that defines a cavity 23.

Figure 4:
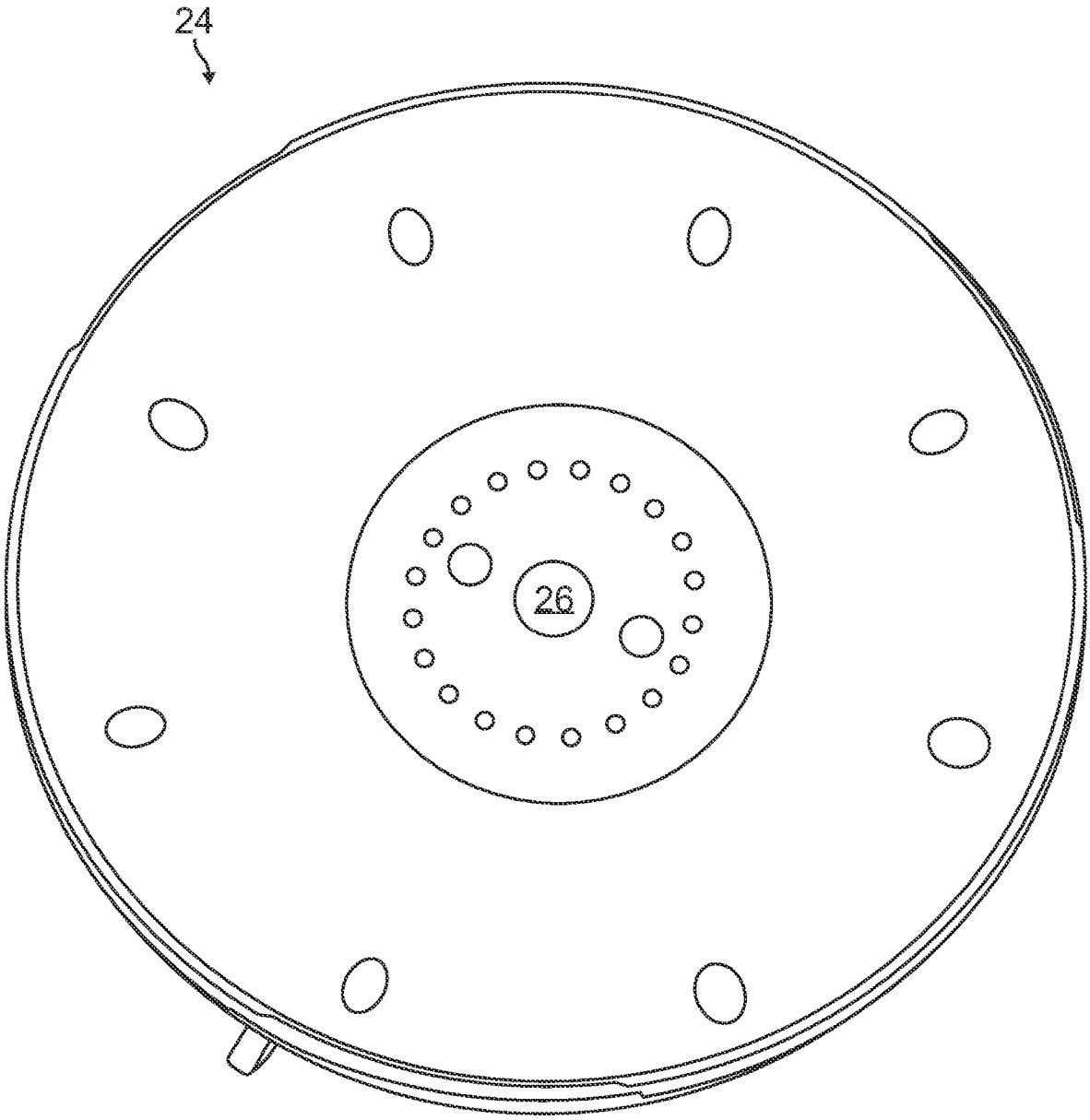
FIG. 4 is a plan view of the components of one embodiment of a snack containment and dispensing apparatus in accordance with the principles of the present disclosure.
Figure 5:
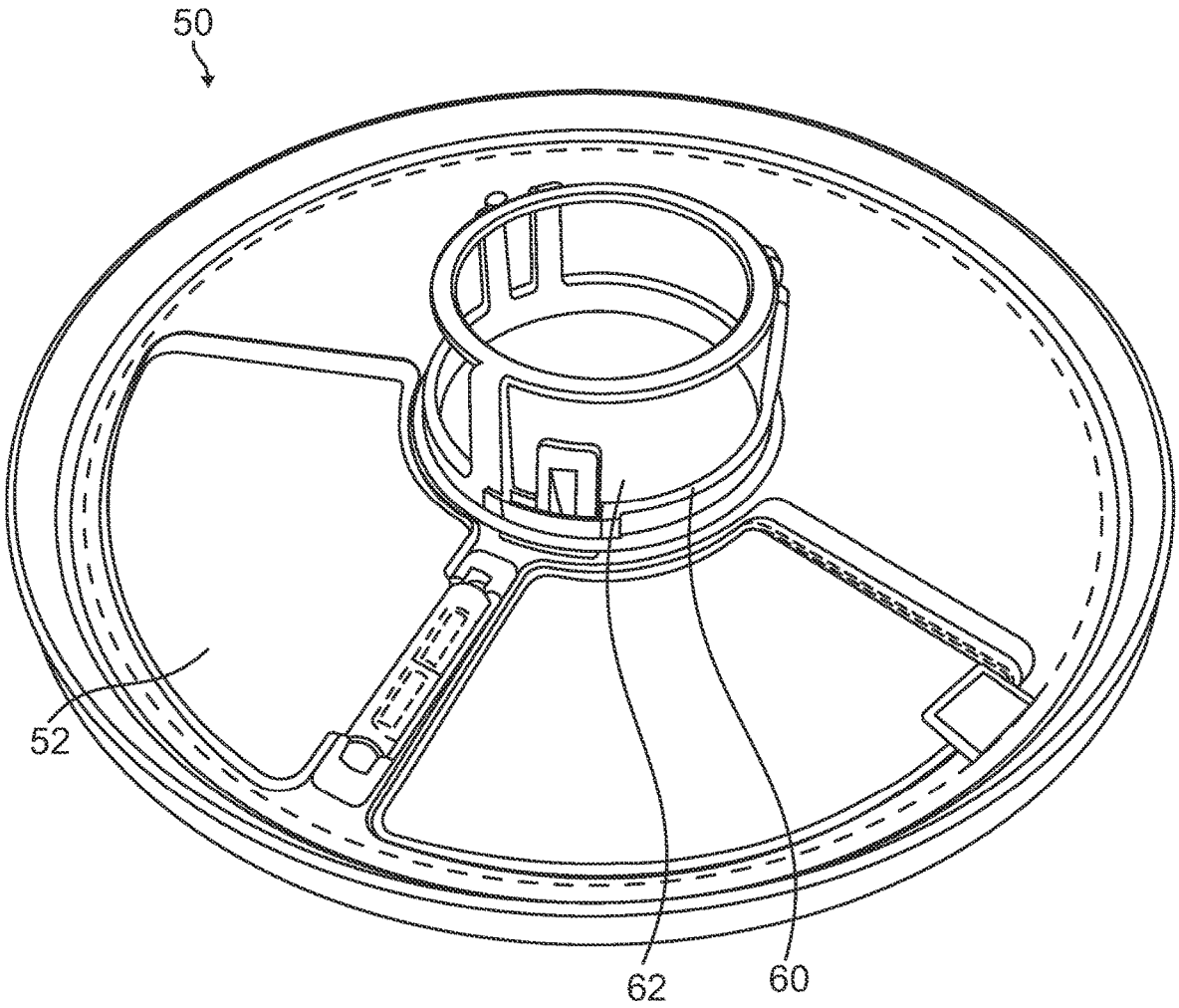
FIG. 5 is a plan view of the components of one embodiment of a snack containment and dispensing apparatus in accordance with the principles of the present disclosure.
Figure 6:
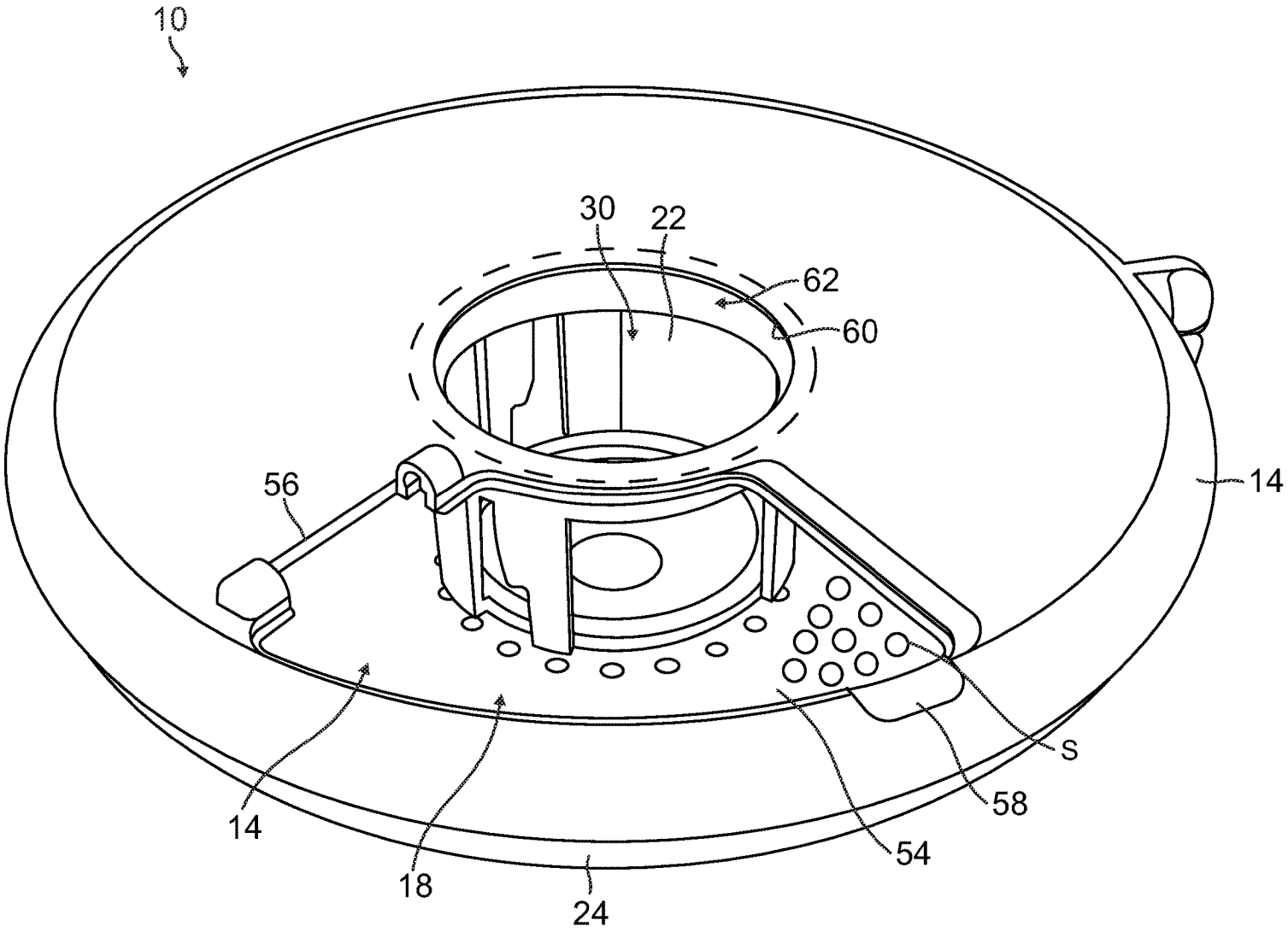
FIG. 6 is a perspective view of components of one embodiment of a snack containment and dispensing apparatus in accordance with the principles of the present disclosure.
Figure 7:
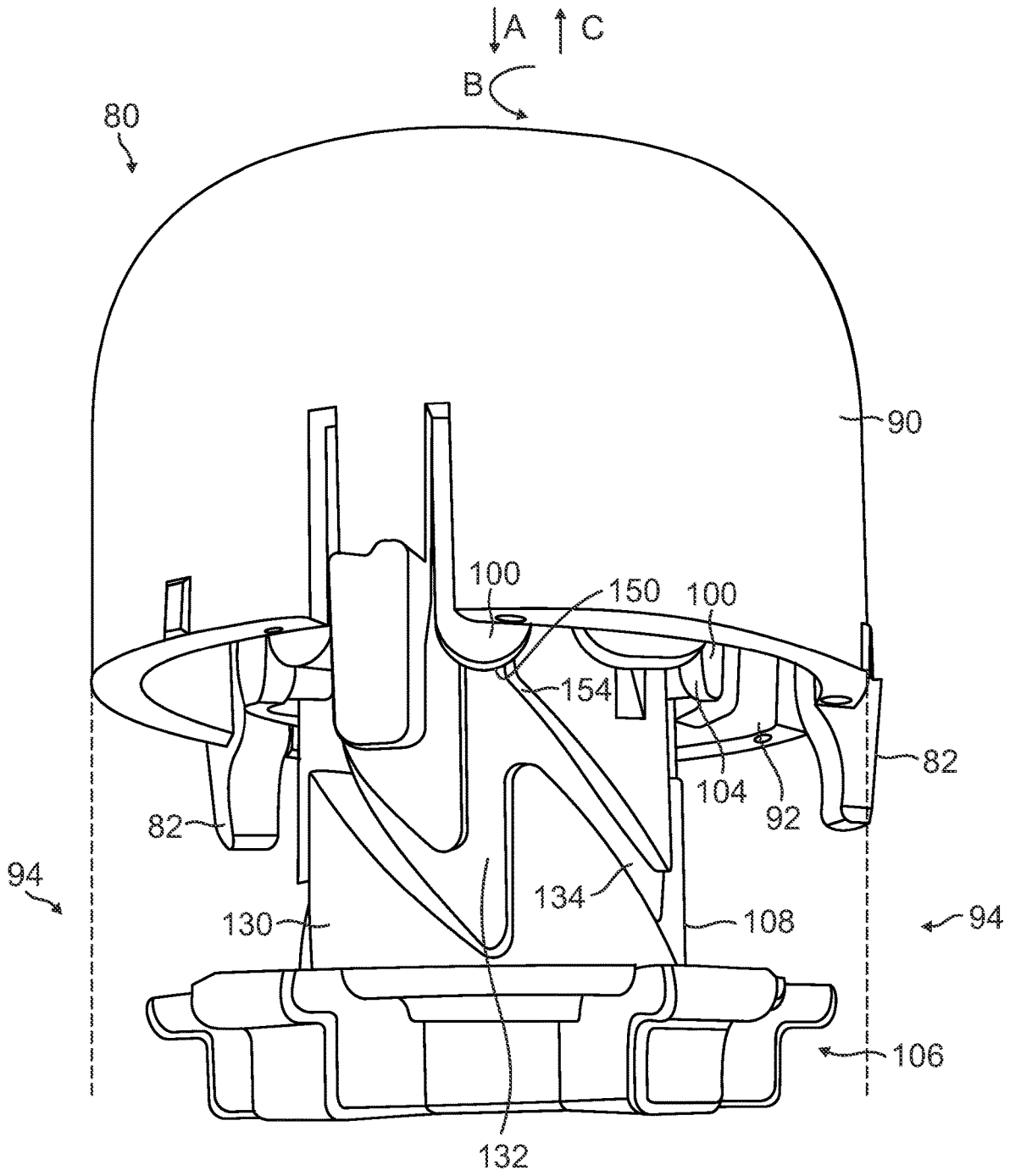
FIG. 7 is a perspective view of components of one embodiment of a snack containment and dispensing apparatus in accordance with the principles of the present disclosure.

In some embodiments, tray 14 is disposed with a bowl 24. Bowl includes an inner bottom surface that defines a protrusion, for example, a spindle 26, as shown in FIG. 4. Spindle 26 is configured for disposal with cavity 23 to facilitate rotation of tray 14 relative to bowl 24, as described herein.

Opening 22 defines a housing 30. Housing 30 includes a bottom surface 32 and a side wall 34. Housing 30 is configured for disposal of an actuator 80, as described herein. Housing 30 is substantially centrally located with tray 14 such that pockets 18 are disposed circumferentially about housing 30. Surface 32 includes an upwardly projecting spindle protrusion 36 and a plurality of drive knobs 38 substantially equidistantly located circumferentially about protrusion 36. Knobs 38 are separated by a gap 37. Knobs 38 each include a first ramp surface 40 and a second ramp surface 42. Surface 40 and surface 42 merge at an apex 44. In operation, a portion of actuator 80 is configured to translate along ramp surface 40, over apex 44 and along ramp surface 42 and into gap 37. When the portion of actuator 80 is disposed with gap 37, actuator is releasably fixed with tray 14 to resist and/or prevent rotation, as described herein. In some embodiments, knobs 38 are equally distributed. In some embodiments, the number of knobs 38 equals the number of pockets 18 to facilitate alignment of pockets 18 with opening 52, as described herein.

To keep snacks S from falling out of tray 14 during transport and/or maintain the freshness of snacks S, tray 14 includes a lid 50, as shown in FIGS. Lid 50 is substantially clear for viewing snacks S therethrough. Lid 50 includes a substantially round, circular shape configured to fit with tray 14.

Lid 50 includes an opening 52 is sized for alignment with one of pockets 18 to allow access to snacks S. Lid 50 includes a hinged flap 54 disposed with opening 52. Flap 54 is configured for disposal and alignment relative to a pocket 18 to allow access to snacks S. Flap 54 is configured for rotation about a hinge 56 for disposal between a closed orientation and an open orientation. Flap 54 includes a lock 58 that is configured to engage a surface of tray 14. In some embodiments, lock 58 is engaged with tray 14 via an integral connection, friction fit, pressure fit, interlocking engagement, mating engagement, dovetail connection, clips, barbs, tongue in groove, threaded, magnetic and/or key/keyslot.

Lid 50 includes a surface 60 that defines an opening 62. Opening 62 is aligned with housing 30 and configured for disposal of actuator 80, as described herein. Lid 50 is fixed with a portion of actuator 80 such that upon actuation of actuator 80 tray 14 is rotated relative to lid 50 to expose a single pocket 18. In some embodiments, actuator 80 includes spring tabs 82 configured to engage a portion of lid 50 to releasably fix actuator 80 with lid 50 to resist and/or prevent rotation of actuator 80 relative to lid. In some embodiments, lid 50 is connected with actuator 80 via an integral connection, friction fit, pressure fit, interlocking engagement, mating engagement, dovetail connection, clips, barbs, tongue in groove, threaded, magnetic and/or key/keyslot.

Actuator 80 includes a button 90, a collar 92, a rotation mechanism 94 and a housing 96. Button 90 includes a circular configuration and is configured to be pressed to actuate actuator 80, as described herein. In some embodiments, actuator 80 is configured as a plunger button.

Collar 92 is disposed with a cavity of button 90. Collar 92 includes a plurality of resiliently biased arms 100. One or more arms 100 includes a pin 104 protruding inwardly. Pins 104 are configured to engage a portion of rotation mechanism 94 to facilitate selective rotation, as described herein. Button 90 is moveable between a release orientation and locked orientation. In the release orientation, button 90 is biased upwards and can be pressed axially to actuate rotation of rotation mechanism 94. In the locked orientation, button 90 is fixed in a depressed orientation to resist and/or prevent rotation.

Figure 8:
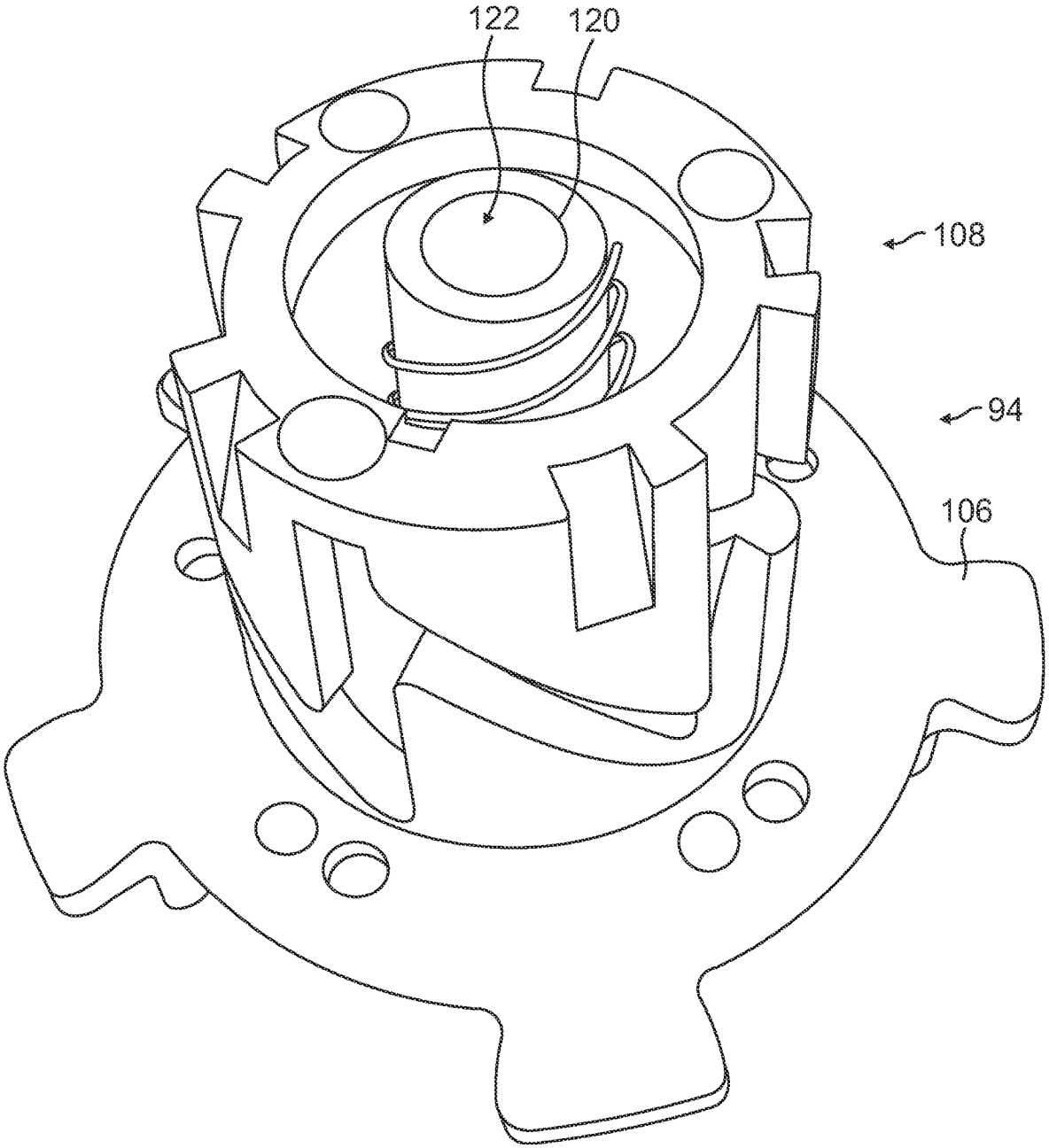
FIG. 8 is a perspective view of a component of one embodiment of a snack containment and dispensing apparatus in accordance with the principles of the present disclosure.
Figure 9:
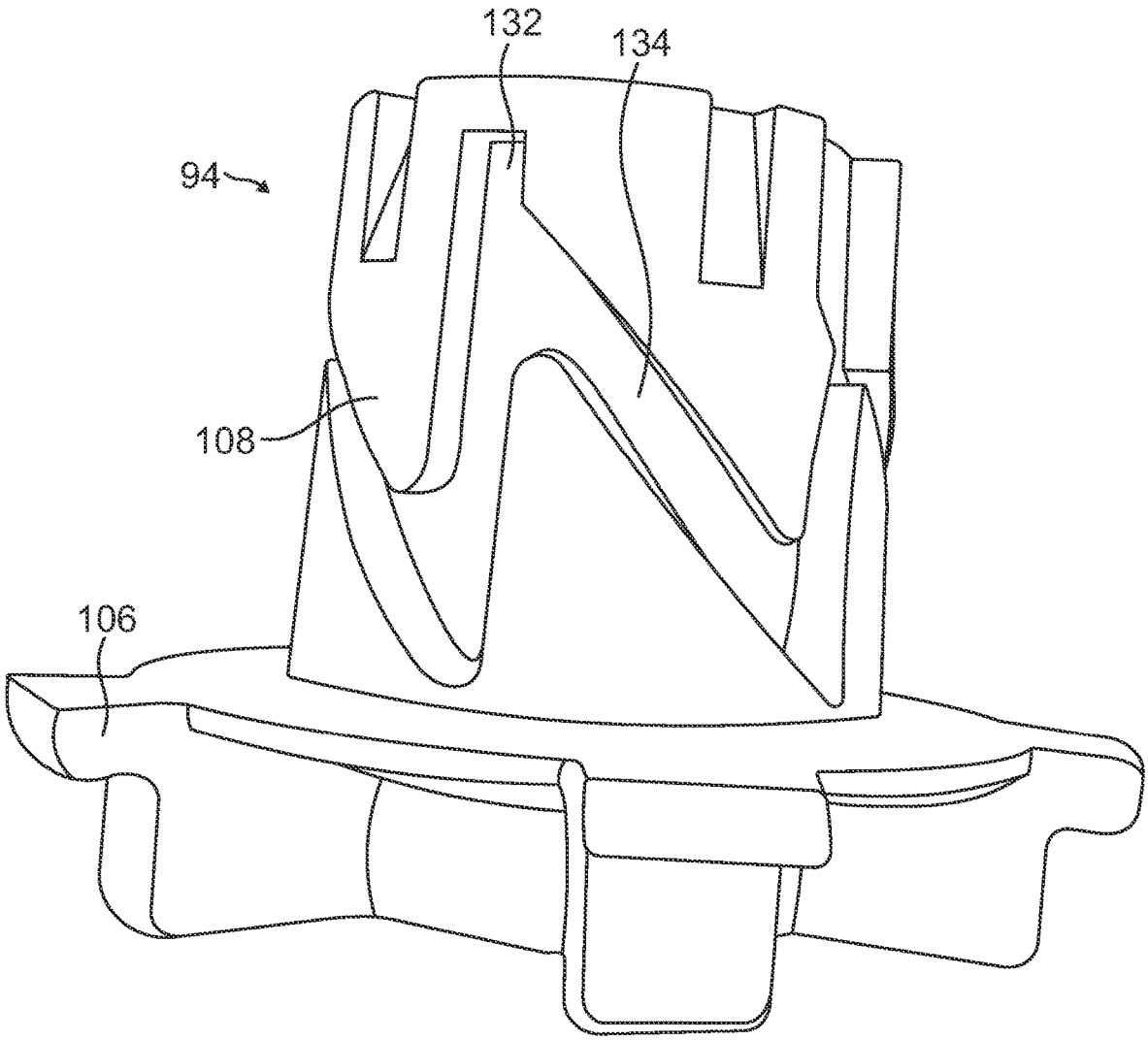
FIG. 9 is a side view of a component of one embodiment of a snack containment and dispensing apparatus in accordance with the principles of the present disclosure.
Figure 10:
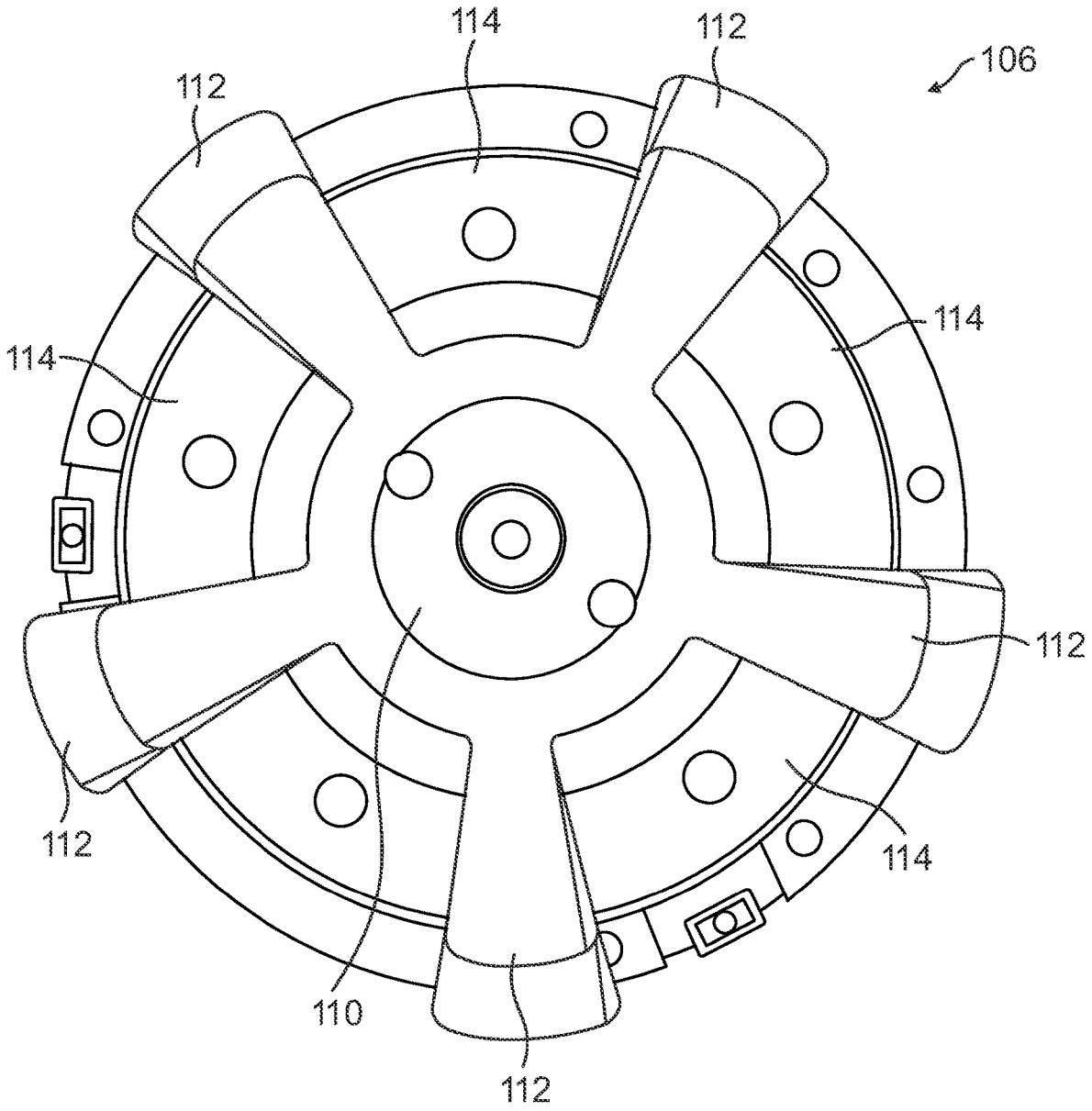
FIG. 10 is a bottom view of a component of one embodiment of a snack containment and dispensing apparatus in accordance with the principles of the present disclosure.
Figure 11:
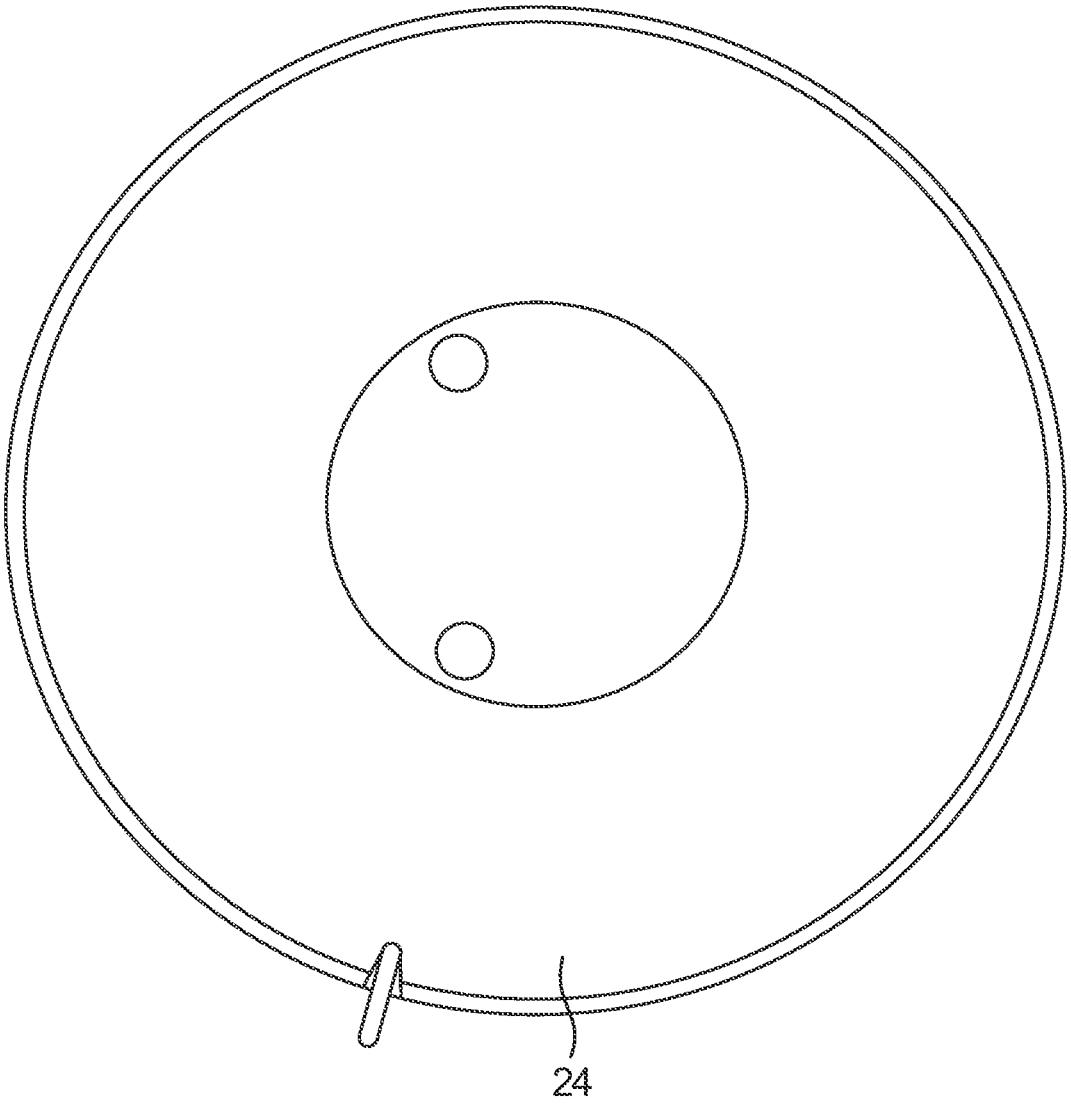
FIG. 11 is a bottom view of components of one embodiment of a snack containment and dispensing apparatus in accordance with the principles of the present disclosure.
Figure 12:
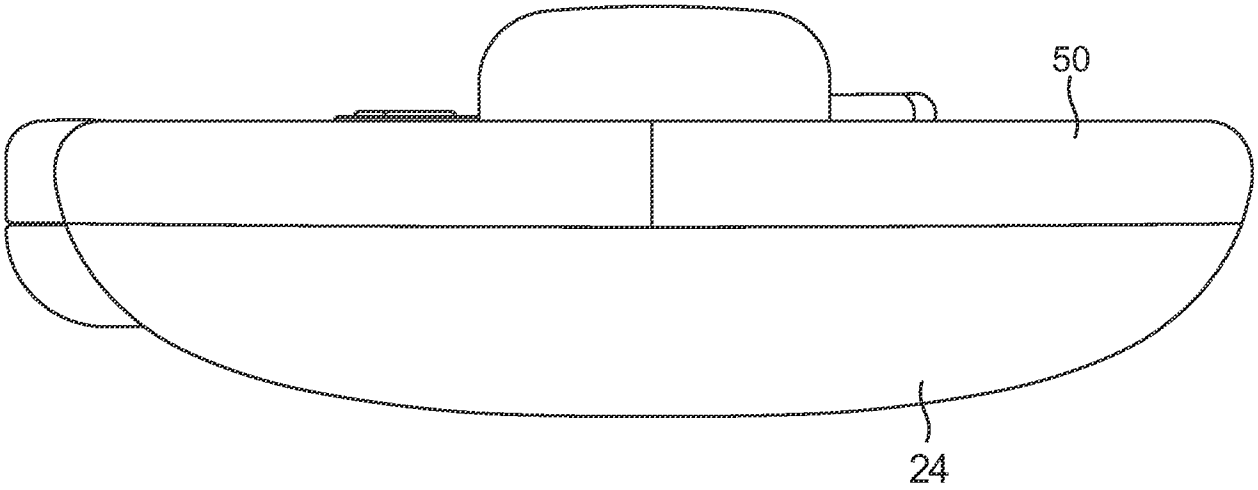
FIG. 12 is a side view of components of one embodiment of a snack containment and dispensing apparatus in accordance with the principles of the present disclosure.
Figure 13:
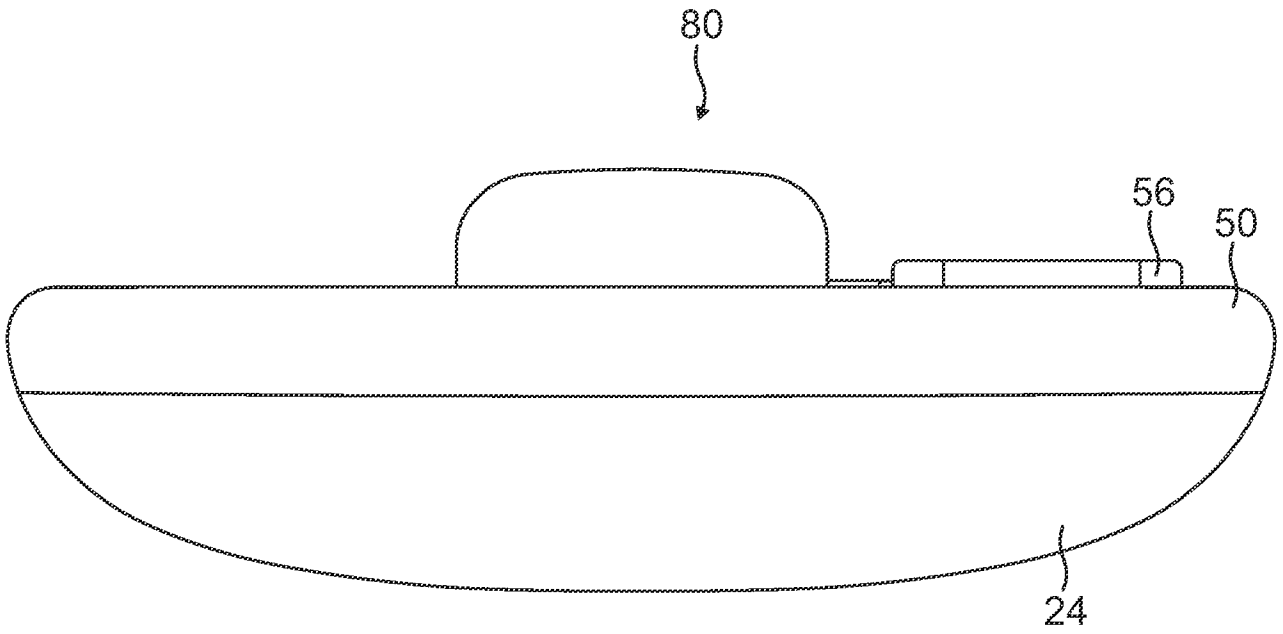
FIG. 13 is a side view of components of one embodiment of a snack containment and dispensing apparatus in accordance with the principles of the present disclosure.
Figure 14:
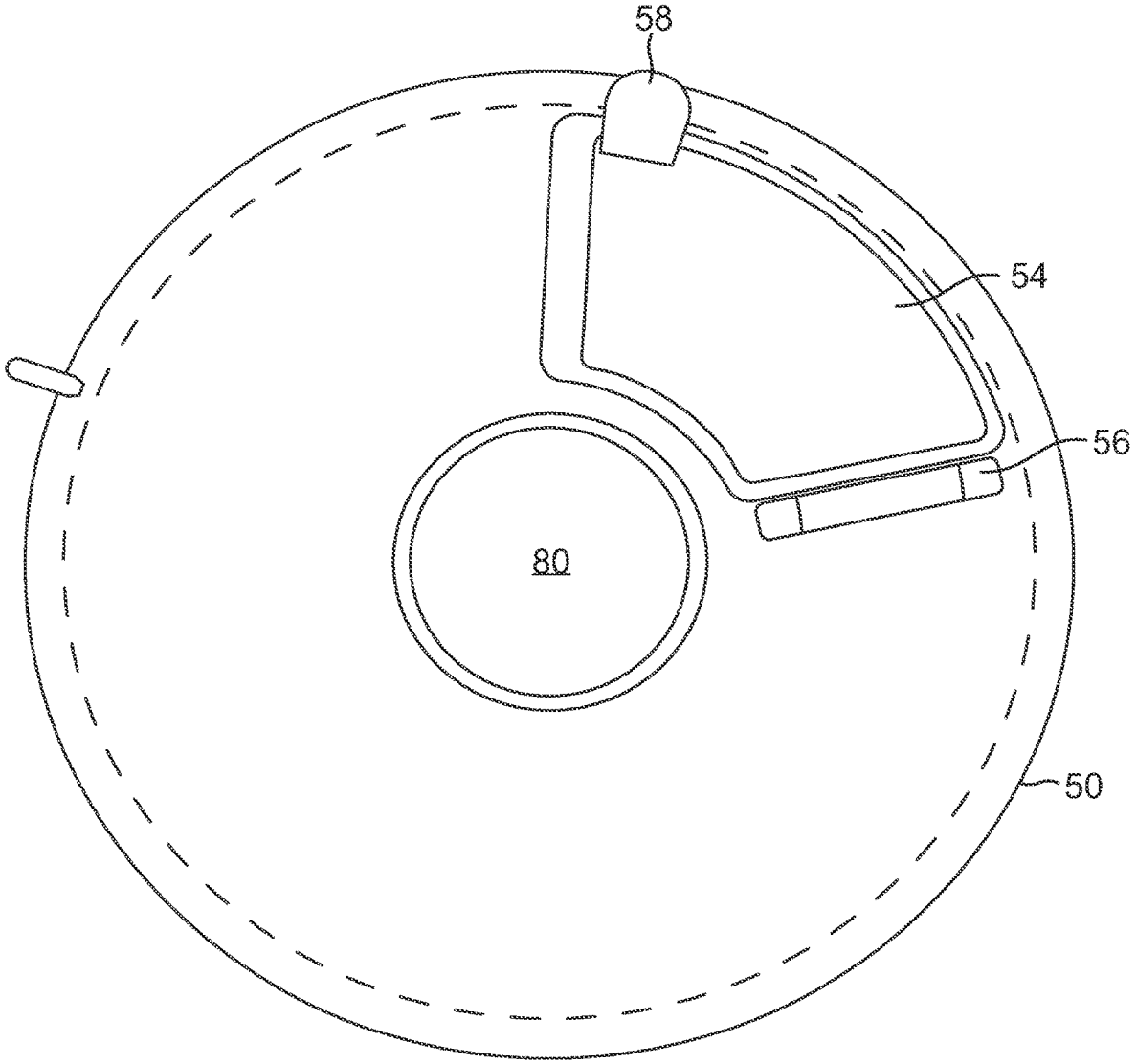
FIG. 14 is a top view of components of one embodiment of a snack containment and dispensing apparatus in accordance with the principles of the present disclosure.
Figure 15A:
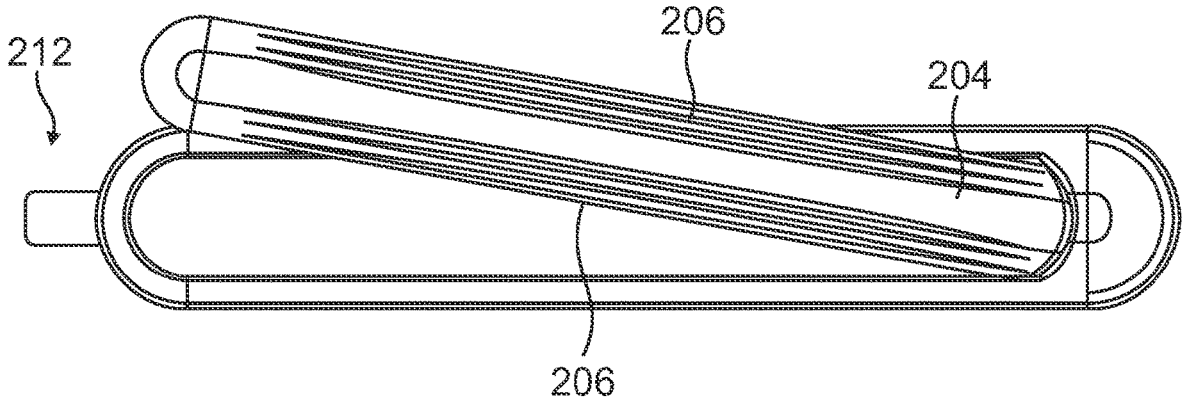
FIG. 15A is a top view of the door latch with button release.
Figure 15B:
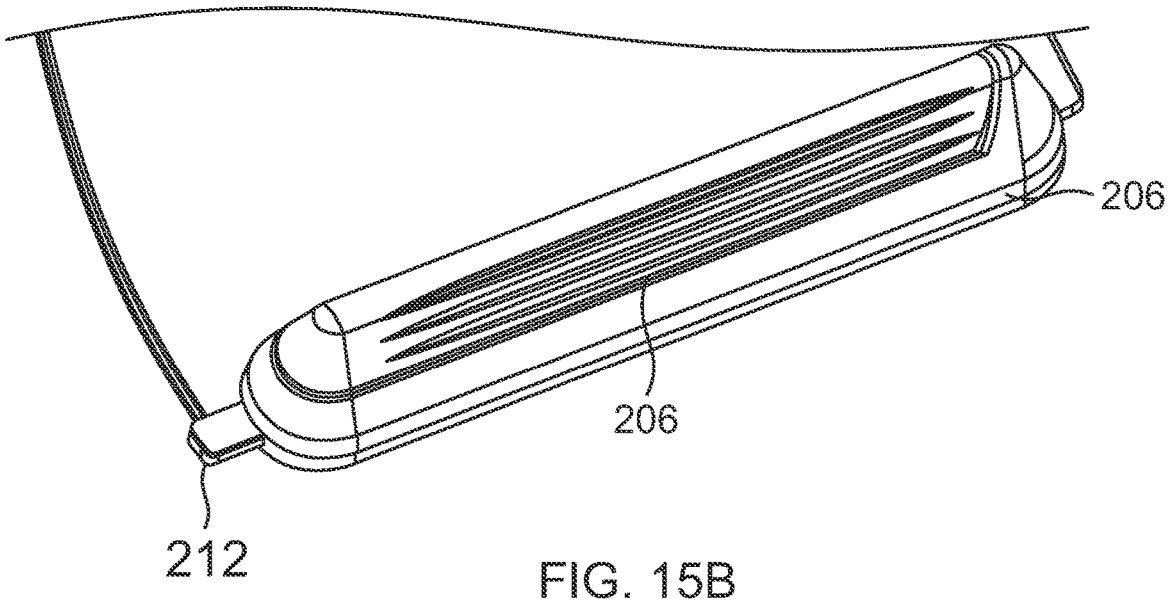
FIG. 15B is a top perspective view of a portion of the lid where the door latch with button release is located.
Figure 15C:
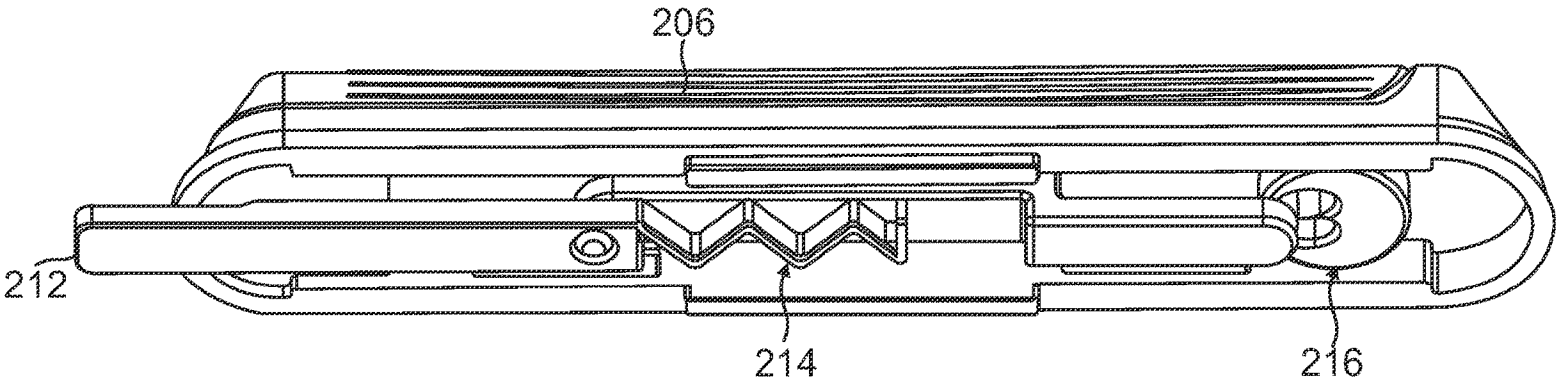
FIG. 15C is a bottom view of the lid where the door latch with button release is visible and the actuator components.
Figure 15D:
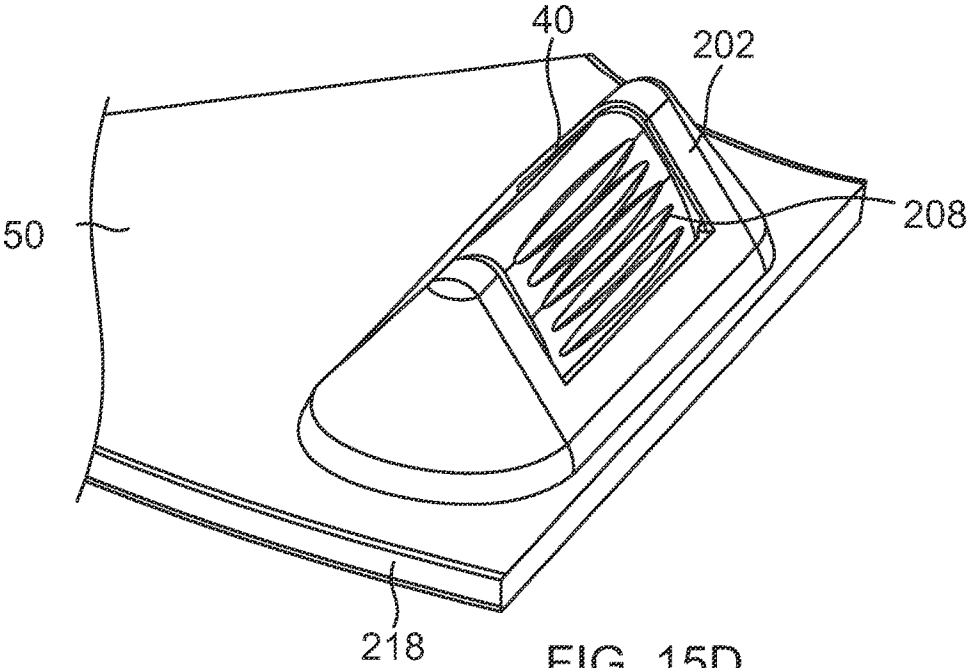
FIG. 15D is a top perspective view of an alternate embodiment of the door latch with button release.

Rotation mechanism 94 includes a base 106 and a tubular portion 108, as shown in FIGS. 8-10. Base 106 includes a cavity 110 configured for disposal of protrusion 36 to facilitate rotation of tray 14. Base 106 includes a plurality of extensions 112 circumferentially and equidistantly disposed about cavity 110. Extensions 112 protrude distally and are configured for disposal in gaps 37 of housing 30. Extensions 112 define drive pockets 114 therebetween. Drive pockets 114 are configured for disposal of knobs 37. During rotation, extensions 112 are configured to translate along ramp surface 40, over apex 44 and along ramp surface 42 such that knob 37 is disposed with an adjacent drive pocket 114 to facilitate selective rotation of tray 14.

Tubular portion 108 includes an in inner surface 120 that defines a cavity 122. Cavity 122 is configured for disposal of a biasing member, for example, a spring. The biasing member is configured to spring load button 90. The biasing member biases button into the release orientation between rotations of tray 14.

Tubular portion 108 includes an outer surface 130. Surface 130 includes a plurality of vertical channels 132 connected by transverse channels 134. At least one vertical channel 132 includes a ramped surface 136, inclining from a distal end to a proximal end. At least one transverse channel 134 includes a ramped surface 138, inclining from the proximal end towards the distal end. Channels 132 include a proximal portion 150 having a wall 154. Wall 154 is configured to resist and/or prevent unwanted rotation of actuator 80. Upon actuation, for example, pressing button 90 downward, as shown by arrow A in FIG. 7, pin 104 translates around wall 154 and distally along transverse channel 134. This causes rotation, in a direction shown by arrow B in FIG. 7, of rotation mechanism 94 and simultaneous rotation of tray 14. Releasing button 90, in a direction shown by arrow C in FIG. 7, causes pin 104 to translate proximally along channel 132 and into engagement with an adjacent proximal portion 150 and wall 154.

In some embodiments, tray 14 includes five pockets 18 and the selective rotation is one fifth of 360 degrees, for example, each rotation is 72 degrees. This selective rotation of 72 degrees is accomplished by collar 92 having five pins 104, rotation mechanism 94 having five vertical channels 132 and five transverse channels 134 equally disposed about rotation mechanism 94.

Container system 10 can be assembled and disassembled for cleaning and/or storage. For example, actuator 80 device is assembled such that the actuator 80 is rotatably positioned within lid 50 and housing 30 and actuator 80 is connected with lid 50 via spring tabs 82. Tray 14 is placed within bowl 24 such that tray 14 may substantially freely rotate. Base 106 is placed in housing 30 such that the drive pockets 114 are in drive contact with the knobs 38, and such that lid 50 comes into engagement contact with bowl 24.

With container system 10 assembled, actuator 80 is actuated, as described herein, which in turn causes tray 14 to index and/or rotate a predetermined and/or selected amount relative to bowl 24 such that an exposed pocket 18 is accessible and an unexposed containment compartment is closed. When the containment compartments contain a snack, a user, especially a child, experiences the entertainment and autonomy of choosing which snack to expose and subsequently retrieve and consume. It shall be noted that if all of the compartments contain a snack and the apparatus is overturned, only the snack in the open compartment is susceptible to spilling.

One embodiment of the instant invention involves a door latch with a button release as illustrated in FIGS. 15A-15D. In this embodiment, the lid 50 and hinged flap 54 includes a door latch that acts as a toggle button 200, 202. Two separate types of toggle buttons 200, 202 are disclosed. The first one, shown in FIGS. 15A-15C sits atop the lid 50 raised above the plane of the lid. The first toggle button 200 has a first side 204 and a second side 206. The user pushes the toggle button 20 from either the first side 204 or the second side 206 which activates a sliding mechanism 212 that sits on the underside of the toggle button 200. The sliding mechanism 212 is connected to a compliant spring 214 which brings force to the sliding mechanism 212. The sliding mechanism 212 is attached to a cam wheel 216 that allows the compliant spring 214 to move one direction or the other. When activated through pushing of one of the sides 204, 206, the sliding mechanism 212 either moves away from the lid 50 and toward the perimeter where it can then be lodged under the lid 50, thereby holding the position of the hinged flap 54 so it can be opened the contents inside accessed.

The alternate version of the door latch toggle button 202 has its own two sides 208, 210 which can be toggled to activate it. Rather than a sliding mechanism, this embodiment has a cantilever 218 that is moved downward when activated where it can then catch on a portion of the lid 50 and the device 10 to lock it in place to access a specific location through opening of the hinged flap 54

Figure 16:
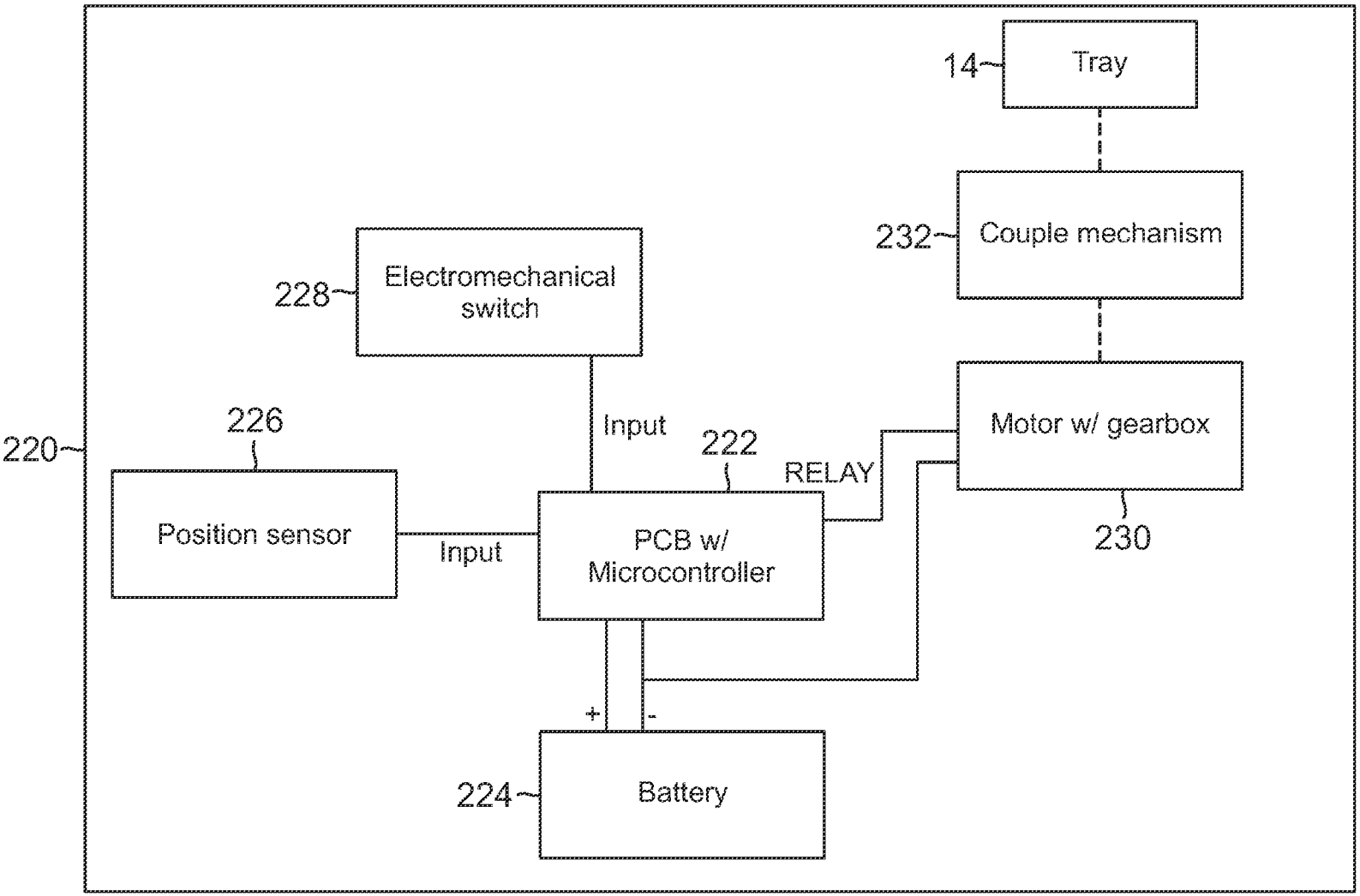
FIG. 16 is a schematic of the components of the motorized embodiment of the device of the instant invention.

Another alternate embodiment utilizes electromechanical means to activate the motion of the device 10. A schematic 220 of the elements of this embodiment are shown in FIG. 16. In this embodiment, there is an electromechanical button switch 228 that is used to control the device 10. The electromechanical switch 228 inputs instructions to a PCB with microcontroller 22 that is powered by a battery 224 power source. The PCB with microcontroller 22 is connected to a position sensor 226 which determines the position of the elements of the device 10. Additionally, the PCB with microcontroller 22 is connected to a motor with a gear box 230 that is attached via a coupling mechanism 232 to the tray 14. This embodiment not allows the device 10 to operate electromechanically, but it also provides a means for collecting data about the device 10.

Figure 17:
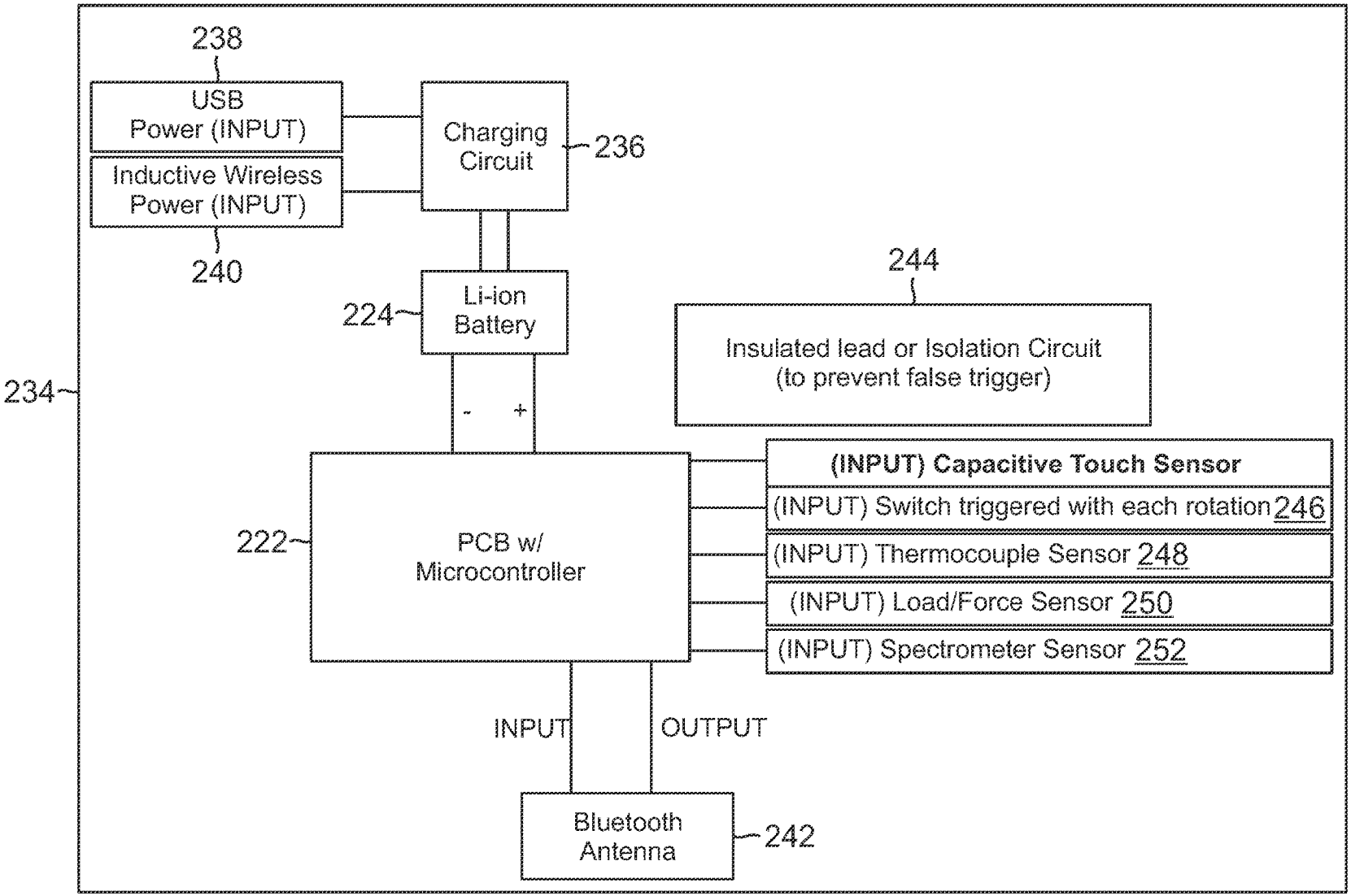
FIG. 17 is a schematic of the components of the tracking system for the electronics in the motorized embodiment of the device of the instant invention.

FIG. 17 is a schematic 234 of the tracking and data collection and use potentials of this embodiment. The PCB with microcontroller 222 connected to a power source, such as a battery 224 can be connected to a charging circuit 236 with USB power inputs 238 and inductive wireless power inputs 240. The PCB with microcontroller 222 can both input and output to and from a BLUETOOT® antenna 242 Insulated leads or isolated circuits are used to prevent false triggers and connect capacitive touch sensors 244 to the PCB with microcontroller 222. Other inputs to the PCT with microcontroller 222 include a switch triggered with each rotation 246, a thermocouple sensor 248, a load/force sensor 250 and a spectrometer sensor 252. These electronics allow for the tracking of data that includes rotations, door open/close cycles, how much food is in the tray 14, the type of food in the tray 14, how much food is consumer. These electronics provide for the ability to connect these electronics to a phone or other device via BLUETOOTH® to report and collect this data.

Figure 18A:
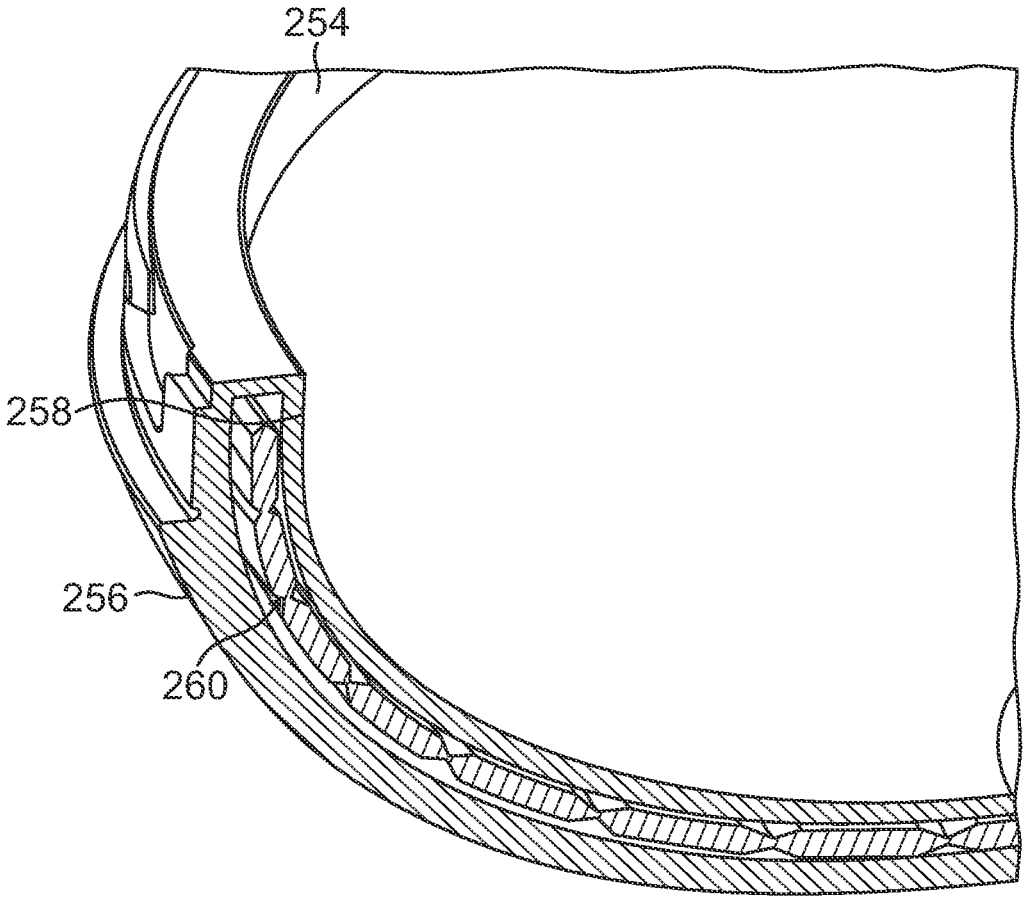
FIG. 18A is a cutaway view of a portion of the device of the instant invention showing the passive temperature controlling component.
Figure 18B:
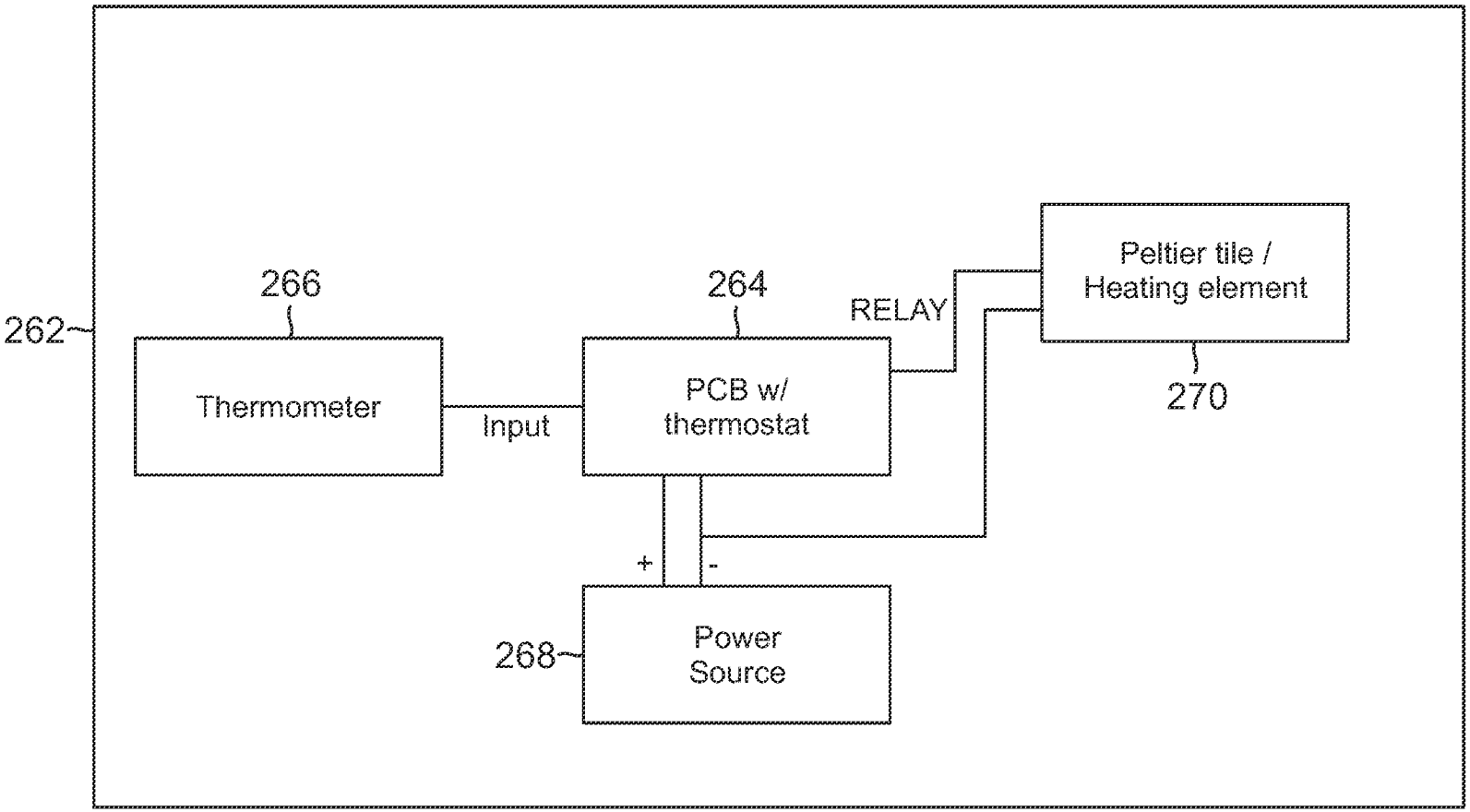
FIG. 18B is a schematic view of the active temperature controlling system integrated electronically into the device of the instant invention.

Yet another embodiment of the instant invention includes the ability to passively or actively control the temperature of the device 10. FIGS. 18A-18B illustrate these aspects. FIG. 18A illustrates the passive mode of temperature control. In this embodiment, the device 10 can include a double-sided wall, defined by an interior wall 254 and an exterior wall 256 with an interior space 260 therebetween or it can simple be a double-sided wall, defined by an interior wall 254 and an exterior wall 256 without an interior space therebetween.

In the case of the double sided wall including an interior space 260, either a heating pack or a cooling pack of known types can be nestled therein. In this way, the contents of the device 10 can either be warmed or cooled passively depending on which type of pack is included, as desired by the user. The heating or cooling pack can be liquid or solid with a high specific heat capacity, such as liquid water or greater.

In the case of a double sided wall without the interior space, the substance of high specific heat is attached directly either to the interior wall 254 or the exterior wall 256. Additionally, heating and cooling elements can be placed in the bowl of the device.

Active heating and cooling can also be accomplished with electronic means and is illustrated schematically in FIG. 1813. In this embodiment, active cooling or heating is accomplished using heating elements or cooling elements integrated into the device 10. Heating elements or Peltier tiles 270 are placed inside the bowl or on the surface of the bowl to heat or cool the food in the tray and are connected to the PCB with thermostat 264 which is connected to an exterior power source 268. The electrical elements include a power source 268, a thermometer 266 and thermostat 264, a relay and the heating/cooling element 270, as shown in the schematic 262.

Figure 19A:
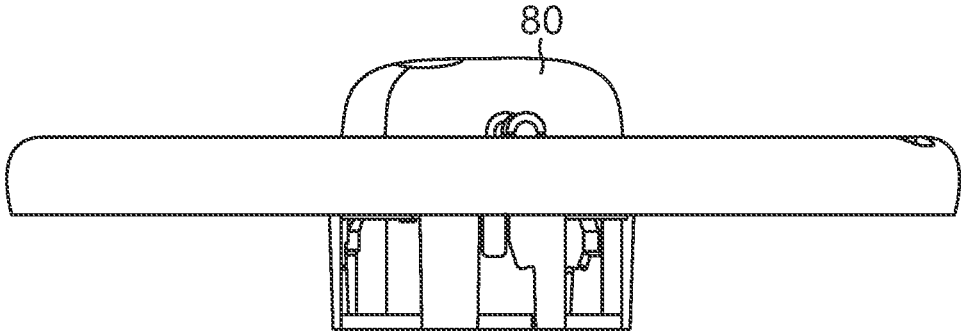
FIG. 19A is a side view of the device of the instant invention showing the button locking mechanism with the button in the up position.
Figure 19B:
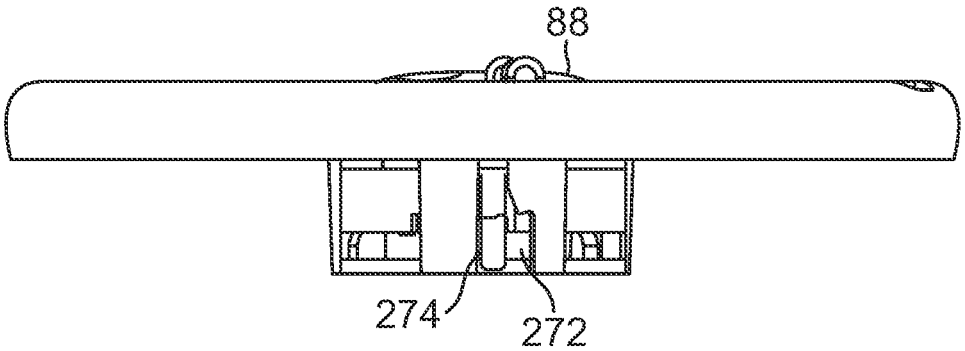
FIG. 19B is a side view of the device of the instant invention showing the button locking mechanism with the button in the fully depressed position.
Figure 19C:
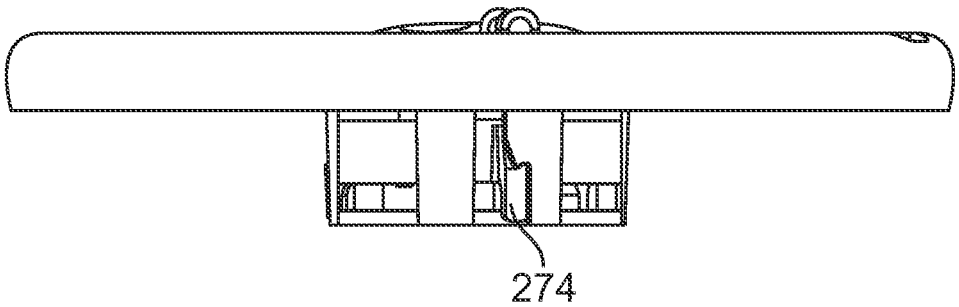
FIG. 19C is a side view of the device of the instant invention showing the button locking mechanism rotated into the locked position.

Another feature of the instant inventions allows for a means of locking down the actuator button 80 for storage and/or when not in use. This feature is illustrated in FIGS. 19A-19C. For this feature, the actuator button 80 has near the bottom of its structure includes a female member 272 and a male member 274. When not locked down, the female member 272 and male member 274 are not attached. However, once the actuator button 80 is depressed, it can be rotated to a certain degree such that the male member 274 is wedged into the female recess 272 and the button 80 is locked into place until rotated back to the unlocked position, where it is ready to be used again.

Figure 20:
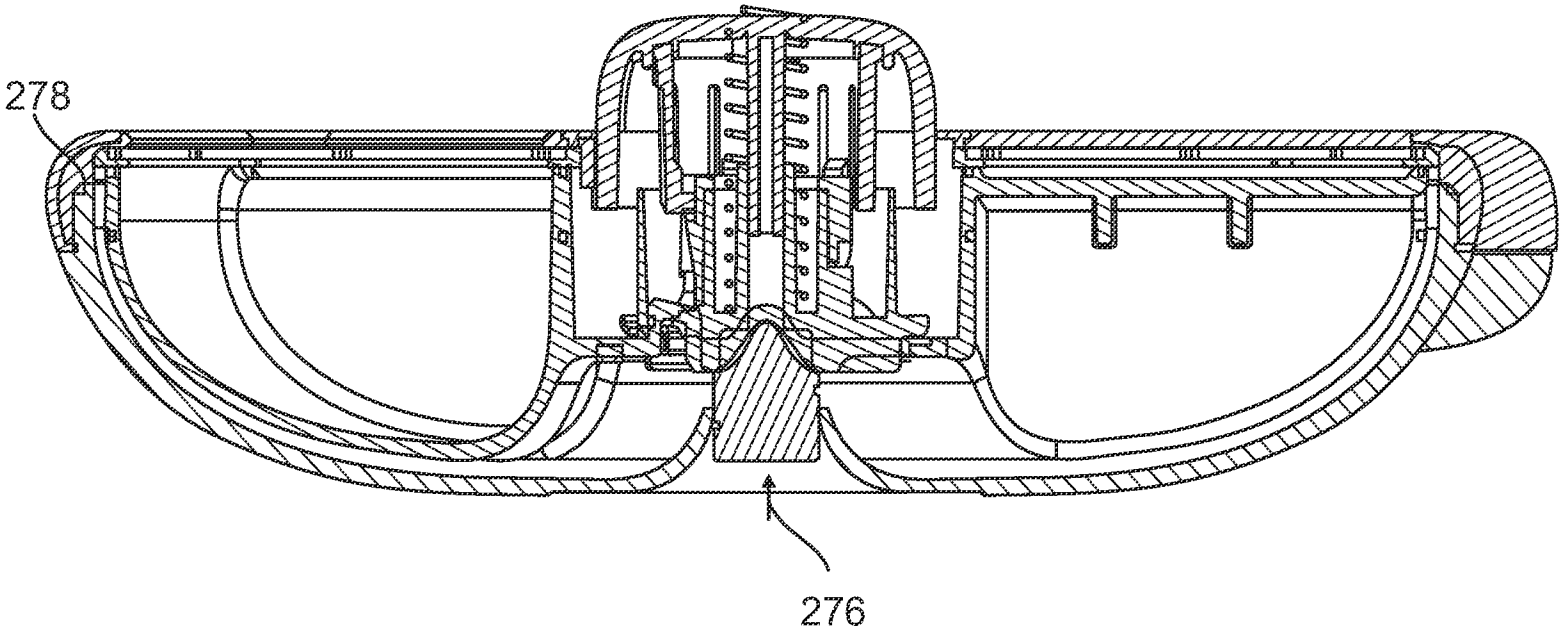
FIG. 20 is a side cutout view of the airtight sealing mechanism of the device of the instant invention.

Another feature of the instant invention allows for the inclusion of elements that provide for a way to provide an airtight seal between the lid 50 and the tray 14. This feature is illustrated in FIG. 20. On the underside of the tray 14 and below where the actuator button 80 is located is found a twisting knob 276 that can be activated which lifts the tray 14 up through a cammed or screw mechanism, causing the top edges of the tray 14 to engage with the lid 50 with enough friction to engage seals 278 along the rims of the tray 14, thereby creating an airtight seal.

Figure 21:
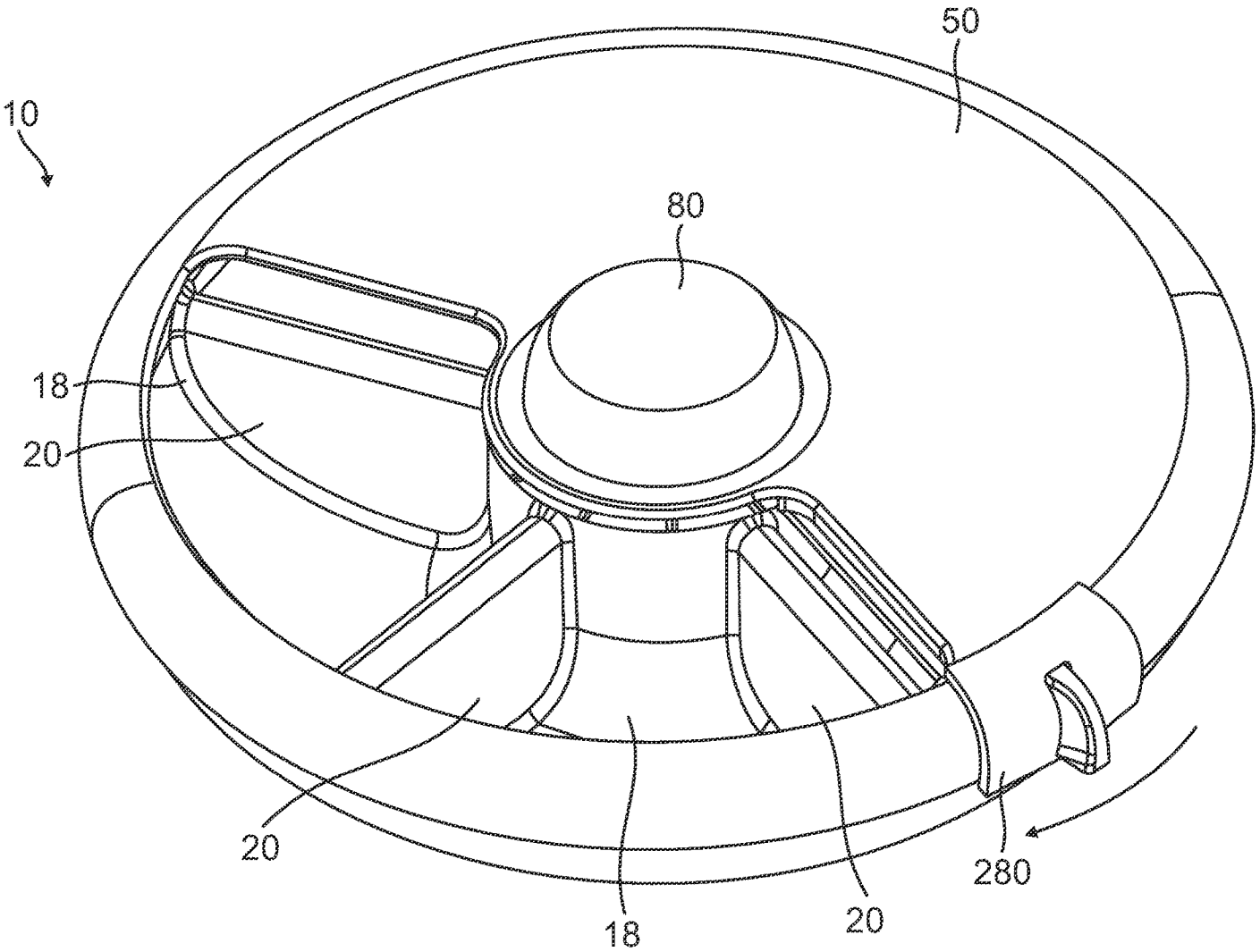
FIG. 21 is a top perspective view of the device of the instant invention showing the ratcheting handle mechanism.

Another feature of the instant invention includes an alternate mechanism of rotating the tray 14. This feature is illustrated in FIG. 21. This method employs a sliding, ratcheting handle 280 near the perimeter of the snack tray 14 or offset some distance from the center of rotation. Instead of using the plunging actuator button 80 motion to activate the device 10, this ratcheting handle 280 can be employed.

To remove any potential issues with stick-slip friction, which can cause a squeaky noise and higher friction when used, the device 10 can be fabricated with materials that combine POM and TPFE in the polymer resin together, which results in lower friction on the parts that slide together.

Additionally, the device 10 could be manufactured such that when the actuator button 80 is activated, rather than the tray 14 rotating, the lid 50 can rotate while the tray 14 stays stationary.

It will be understood that various modifications may be made to the embodiments disclosed herein. Therefore, the above description should not be construed as limiting, but merely as exemplification of the various embodiments. Those skilled in the art will envision other modifications within the scope and spirit of the claims appended hereto.

The invention illustratively disclosed herein suitably may be practiced in the absence of any element which is not specifically disclosed herein.

The discussion included in this patent is intended to serve as a basic description. The reader should be aware that the specific discussion may not explicitly describe all embodiments possible and alternatives are implicit. Also, this discussion may not fully explain the generic nature of the invention and may not explicitly show how each feature or element can actually be representative or equivalent elements. Again, these are implicitly included in this disclosure. Where the invention is described in device-oriented terminology, each element of the device implicitly performs a function. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation, be it a variation of any apparatus embodiment, a method embodiment, or even merely a variation of any element of these. Particularly, it should be understood that as the disclosure relates to elements of the invention, the words for each element may be expressed by equivalent apparatus terms even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

What is claimed is:

1. A snack containment and dispensing apparatus comprising:

a tray including one or more pockets;

a lid connectable with the tray and including an opening, the tray is configured for selective rotation relative to the lid to align one of the one or more pockets with the opening;

an actuator configured to actuate rotation of the tray, the actuator includes a rotation mechanism that includes a base and a tubular portion, the tubular portion includes a plurality of vertical channels connected by a plurality of transverse channels to facilitate selective rotation of the tray; and a door latch connected to said lid at said opening, wherein said door latch can releasably attach to said tray by the toggling of said latch from a first position to a second position wherein said door latch is moveable between said first and said second position through the manual depression of a door latch actuator attached to said lid wherein when said door latch actuator is toggled into said first position, said door latch slides into said tray to lock said lid at a specific location and when said door latch actuator is toggled into said second position, said door latch slides out of said tray to release said door latch from said lid at said specific location.

2. A snack containment and dispensing apparatus comprising:

a tray including one or more pockets;

a lid connectable with the tray and including an opening, the tray is configured for selective rotation relative to the lid to align one of the one or more pockets with the opening;

an actuator configured to actuate rotation of the tray, the actuator includes a rotation mechanism that includes a base and a tubular portion, the tubular portion includes a plurality of vertical channels connected by a plurality of transverse channels to facilitate selective rotation of the tray wherein contents in said tray can be temperature controlled through the inclusion of an icepack or a warm pack integrated into a wall of said tray or to a bowl connected to said tray.

3. The snack containment and dispensing apparatus as defined in claim 2 wherein said tray or said bowl can be temperature controlled through the integration of electronics wherein said electronics include a PCB with a thermostat wherein said PCB with said thermostat is connected to a thermometer and a power source and a means to either cool or heat said tray or said bowl.

* * * * *